US011344914B2

(12) United States Patent
Itoh et al.

(10) Patent No.: US 11,344,914 B2
(45) Date of Patent: May 31, 2022

(54) METHOD FOR FORMING MULTI-LAYER COATING FILM

(71) Applicant: KANSAI PAINT CO., LTD., Hyogo (JP)

(72) Inventors: Masayuki Itoh, Aichi (JP); Yushi Kihira, Aichi (JP); Hiroshi Murata, Aichi (JP); Masahiro Omura, Aichi (JP)

(73) Assignee: KANSAI PAINT CO., LTD., Hyogo (JP)

( * ) Notice: Subject to any disclaimer, the term of this patent is extended or adjusted under 35 U.S.C. 154(b) by 419 days.

(21) Appl. No.: 16/349,881

(22) PCT Filed: Nov. 17, 2017

(86) PCT No.: PCT/JP2017/041453
§ 371 (c)(1),
(2) Date: May 14, 2019

(87) PCT Pub. No.: WO2018/092874
PCT Pub. Date: May 24, 2018

(65) Prior Publication Data

US 2021/0276042 A1 Sep. 9, 2021

(30) Foreign Application Priority Data

Nov. 18, 2016 (JP) ..... JP2016-225114

(51) Int. Cl.
*B05D 7/00* (2006.01)
*B05D 3/02* (2006.01)
*B05D 5/06* (2006.01)

(52) U.S. Cl.
CPC ..... *B05D 7/572* (2013.01); *B05D 3/0254* (2013.01); *B05D 5/068* (2013.01); *B05D 7/577* (2013.01)

(58) Field of Classification Search
None
See application file for complete search history.

(56) References Cited

U.S. PATENT DOCUMENTS

| | | | | |
|---|---|---|---|---|
| 6,096,378 | A | 8/2000 | Komatsu et al. | |
| 6,335,057 | B1 | 1/2002 | Noura et al. | |
| 2009/0035476 | A1 | 2/2009 | Uemura et al. | |
| 2014/0004365 | A1* | 1/2014 | Kitazono | B05D 5/066 428/483 |
| 2015/0368484 | A1* | 12/2015 | Shishaku | C09D 133/06 427/385.5 |
| 2018/0214912 | A1 | 8/2018 | Itoh et al. | |
| 2019/0001370 | A1 | 1/2019 | Itoh et al. | |

FOREIGN PATENT DOCUMENTS

| | | |
|---|---|---|
| CA | 3 030 637 | 1/2018 |
| CN | 1201721 | 12/1998 |
| EP | 2 837 432 | 2/2015 |
| EP | 3 441 436 | 2/2019 |
| JP | 63-272544 | 11/1988 |
| JP | 11-90318 | 4/1999 |
| JP | 2003-313500 | 11/2003 |
| JP | 2005-120249 | 5/2005 |
| JP | 2006-95522 | 4/2006 |
| JP | 2009-28690 | 2/2009 |
| JP | 2009-28693 | 2/2009 |
| JP | 2009-155537 | 7/2009 |
| JP | 2011-45805 | 3/2011 |
| JP | 2012-157827 | 8/2012 |
| JP | 2014-4552 | 1/2014 |
| JP | 2015-51385 | 3/2015 |
| JP | 5685044 | 3/2015 |
| JP | 2015-086303 | 5/2015 |
| JP | 2015-107448 | 6/2015 |
| JP | 2016-77998 | 5/2016 |
| JP | 2016-087569 | 5/2016 |
| JP | 5939695 | 6/2016 |
| WO | 2013/154168 | 10/2013 |
| WO | 2017/022698 | 2/2017 |
| WO | 2017/111112 | 6/2017 |
| WO | 2017/135426 | 8/2017 |
| WO | 2017/175468 | 10/2017 |
| WO | 2018/012014 | 1/2018 |

OTHER PUBLICATIONS

Machine Translation of JP 2014-004552 A (Year: 2014).*
Machine Translation of JP 5,939,695 B1 (Year: 2016).*
International Search Report dated Feb. 13, 2018 in International (PCT) Application No. PCT/JP2017/041453.
Notice of Reasons for Refusal dated Aug. 17, 2021 in corresponding Japanese Patent Application No. 2018-551698 with English translation.

* cited by examiner

*Primary Examiner* — Shamim Ahmed
*Assistant Examiner* — Bradford M Gates
(74) *Attorney, Agent, or Firm* — Wenderoth, Lind & Ponack, L.L.P.

(57) ABSTRACT

Provided is a method for forming a multilayer coating film, comprising simultaneously curing an uncured base coating film, an uncured effect coating film, and an uncured clear coating film. In this method, an effect pigment dispersion (Y) that forms the effect coating film contains water, a surface adjusting agent (A), a flake-effect pigment (B), and a rheology control agent (C), and has a solids content of 0.5 to 10 mass %.

10 Claims, No Drawings

METHOD FOR FORMING MULTI-LAYER COATING FILM

TECHNICAL FIELD

The present invention relates to a method for forming a multilayer coating film.

BACKGROUND ART

The purpose of applying paints is mainly to protect materials and impart an excellent appearance. For industrial products, excellent appearance, particularly "texture," is important in terms of enhancing their product power. Although there are various textures for industrial products desired by consumers, luster like metal or pearl (hereinafter referred to as "metallic luster") has recently been desired in the field of automobile exterior panels, automobile components, home electronics, and the like.

Metallic luster is a texture characterized in that the surface has no graininess, like a mirror-finished surface, in that the coated plate looks shiny when viewed nearly perpendicular to the coated plate (highlight), and in that, conversely, the coated plate looks dark when viewed obliquely to the coated plate (bottom). That is, there is a large luminance difference between the highlight region and the bottom region.

Techniques to impart metallic luster to the surface of industrial products include metal plating treatment, metal deposition treatment (e.g., PTL 1), and the like. If metallic luster can be imparted by coating, it is advantageous in terms of ease, cost, and the like.

PTL 2 discloses a method for forming a metallic coating film, the method comprising applying a composition comprising non-leafing aluminum flakes and an organic solvent to an uncured coating surface, and then applying a clear paint.

PTL 3 discloses a metallic paint prepared by diluting a metallic coating material base containing an effect material, a resin-containing non-volatile solid, and a solvent with a diluent comprising a high-boiling solvent and a low-boiling solvent at a dilution rate of 150 to 500%, and adding 5 to 10 parts by weight of viscous resin based on 100 parts by weight of the resin content in the metallic coating material base.

PTL 4 discloses a metallic paint prepared by diluting a coating material base comprising, on a solid basis, 10 to 30% of an effect material, 10 to 50% of a cellulose acetate butyrate resin having a molecular weight of 25,000 to 50,000 (MWn), and an acrylic melamine resin as a balance, with an ester-based solvent and/or a ketone-based solvent at a dilution rate in which the solids content is 1 to 10 wt. %.

PTL 5 discloses a method for forming a multilayer coating film, the method using an effect material-containing base paint comprising colloidal particles containing precious metal and/or metal, and further comprising a coating film-forming resin and a specific mixed solvent.

PTL 6 discloses a method for forming a multilayer coating film, the method using a specific effect material-containing base paint comprising a coating film-forming resin and colloidal particles containing precious metal and/or metal, and the method being used in combination with a specific coating method.

The paints disclosed in PTL 2 to PTL 6 are solvent-based paints. However, in terms of low environmental impact, aqueous paints have recently been required in the field of metallic paints.

PTL 7 discloses an aqueous base paint composition comprising an effect pigment composed of metal flakes obtained by crushing a vapor deposition metal film, and an aqueous cellulose derivative having an acid value of 20 to 150 mgKOH/g (solids content), wherein the aqueous cellulose derivative serves as a main binder resin, and the content of the effect pigment is 20 to 70 mass % as PWC.

However, a coating film formed from the paint disclosed in PTL 7 has insufficient metallic luster.

PTL 8 discloses a method for coating an aqueous base coat paint comprising a flake-effect pigment, the method comprising applying an aqueous base coat paint (A1) adjusted to have a solids content of 20 to 40 wt. % in the paint to a substrate so that the dry film thickness is 1 to 15 μm, and then applying an aqueous base coat paint (A2) adjusted to have a solids content of 2 to 15 wt. % in the paint to the uncured coating film so that the dry film thickness is 0.1 to 5 μm.

However, coating films formed by the coating method disclosed in PTL 8 have insufficient metallic luster.

PTL 9 discloses a paint composition comprising vapor deposition metal foil having an average particle size ($D_{50}$) of 10 μm or more and 12.5 μm or less, and a thickness of 0.02 μm or more and 0.05 μm or less, a resin, and a solvent; wherein the vapor deposition metal foil is contained in an amount of 100 parts by weight or more and 900 parts by weight or less based on 100 parts by weight of the resin; and when a coating film of a coated article formed by applying the paint composition to a substrate has a film thickness of 0.5 μm or more and 1.5 μm or less, the specular gloss of 20° mirror reflection of the coated article is 300 or more, and the normal reflectance in a visible light region is 40% or more. However, PTL 9 is silent about the anti-water adhesion of the coating film.

CITATION LIST

Patent Literature

PTL 1: JPS63-272544A
PTL 2: JPH11-90318A
PTL 3: JP2003-313500A
PTL 4: JP2005-120249A
PTL 5: JP2009-028690A
PTL 6: JP2009-028693A
PTL 7: JP2009-155537A
PTL 8: JP2006-095522A
PTL 9: JP5685044B

SUMMARY OF INVENTION

Technical Problem

An object of the present invention is to provide a method for forming a multilayer coating film, whereby a metallic coating film having excellent metallic luster and anti-water adhesion can be formed.

Solution to Problem

In order to achieve the above object, the present invention includes the main subjects shown in the following items.

Item 1. A method for forming a multilayer coating film by sequentially performing the following steps (1) to (5):

(1) applying a colored paint (W) to a substrate, followed by heating, to form a colored coating film, (2) applying a base paint (X) to the colored coating film formed in step (1) to form a base coating film, (3) applying an effect pigment dispersion (Y) to the base coating film formed in step (2) to form an effect coating film, (4) applying a clear paint (Z) to the effect coating film formed in step (3) to form a clear coating film, and (5) heating the uncured base coating film, the uncured effect coating film, and the uncured clear coating film formed in steps (2) to (4) to thereby simultaneously cure these three coating films;

wherein the effect pigment dispersion (Y) contains water, a surface adjusting agent (A), a flake-effect pigment (B), and a rheology control agent (C), and has a solids content of 0.5 to 10 mass %.

Item 2. The method for forming a multilayer coating film according to Item 1, wherein the effect pigment dispersion (Y) has a viscosity (B60) of 60 to 2000 mPa-s measured using a Brookfield type viscometer at a rotor rotational speed of 60 rpm at a temperature of 20° C.

Item 3. The method for forming a multilayer coating film according to Item 1 or 2, wherein the surface adjusting agent (A) has a dynamic surface tension of 50 to 70 mN/m.

Item 4. The method for forming a multilayer coating film according to any one of Items 1 to 3, wherein the flake-effect pigment (B) is contained in an amount of 0.2 to 5 parts by mass, based on 100 parts by mass of the effect pigment dispersion (Y).

Item 5. The method for forming a multilayer coating film according to any one of Items 1 to 4, wherein the rheology control agent (C) is a cellulose nanofiber.

Item 6. The method for forming a multilayer coating film according to any one of Items 1 to 5, wherein the effect coating film has a dry film thickness of 0.02 to 5 μm.

Item 7. The method for forming a multilayer coating film according to any one of Items 1 to 6, wherein the base coating film is a transparent coating film or a colored coating film.

Item 8. The method for forming a multilayer coating film according to any one of Items 1 to 7, wherein the clear paint (Z) is a two-component clear paint containing a hydroxy-containing resin and a polyisocyanate compound.

Item 9. The method for forming a multilayer coating film according to any one of Items 1 to 8, wherein the flake-effect pigment (B) is a vapor deposition metal flake pigment, and the multilayer coating film has a 60 degree gloss value of 120 or more and an HG value of 10 to 40.

Item 10. The method for forming a multilayer coating film according to any one of Items 1 to 8, wherein the flake-effect pigment (B) is an aluminum flake pigment, and the multilayer coating film has a 60 degree gloss value of 105 or more and an HG value of 35 to 65.

Advantageous Effects of Invention

According to the method for forming a multilayer coating film of the present invention, a coating film having excellent metallic luster and anti-water adhesion is obtained.

DESCRIPTION OF EMBODIMENTS

The method for forming a multilayer coating film of the present invention is described in more detail below.

1. Step (1)

Step (1) is to apply a colored paint (W) to a substrate, followed by heating, to form a colored coating film.

Substrate

The substrate to which the method of the present invention can be applied is not particularly limited. Examples include exterior panels of vehicle bodies, such as automobiles, trucks, motorcycles, and buses; automobile components; exterior panels of home appliances, such as mobile phones, audio equipment or the like. Among these, vehicle body exterior panels and automobile components are preferable.

The base materials that constitute these substrates are not particularly limited. Examples include metal plates, such as iron plates, aluminum plates, brass plates, copper plates, stainless steel plates, tin plates, galvanized steel plates, and alloyed zinc (Zn—Al, Zn—Ni, Zn—Fe, and the like)-plated steel plates; resins, such as polyethylene resin, polypropylene resin, acrylonitrile-butadiene-styrene (ABS) resin, polyamide resin, acrylic resin, vinylidene chloride resin, polycarbonate resin, polyurethane resin, and epoxy resin; plastic materials, such as various FRPs; inorganic materials, such as glass, cement, and concrete; wood; fibrous materials (paper, cloth, and the like); and the like. Among these, metal plates or plastic materials are preferable.

Moreover, the above substrate may be one in which an undercoating film is formed on a base material mentioned above. When the base material is made of metal, chemical conversion treatment using phosphate, chromate, and the like, is preferably performed before an undercoating film is formed.

The undercoating film is formed for the purpose of imparting, for example, anticorrosion, antirust, adhesion to the base material, and masking properties for the unevenness of the base material surface. As undercoating paints for forming such undercoating films, those that are themselves known can be used. For example, cationic or anionic electrodeposition paints are preferably applied to conductive base materials, such as metals. Chlorinated polyolefin resin-based paints are preferably applied to low-polarity base materials, such as polypropylene.

After the application, the undercoating paint may be cured by heating, blowing, or like means, or may be dried to an extent not causing curing. When a cationic or anionic electrodeposition paint is used as the undercoating paint, the undercoating paint is preferably cured by heating after applying the undercoating paint so as to prevent the formation of a mixed layer between the undercoating film and a coating film sequentially formed on the undercoating film, and to form a multilayer coating film of excellent appearance.

Colored Paint (W)

The colored paint (W) is used to ensure surface smoothness of the coating film, and to strengthen coating film properties, such as impact resistance and chipping resistance. The "chipping resistance" mentioned herein is tolerance to damage to coating films caused by collision of obstructions, such as small stones.

The colored paint (W) used in this step is preferably a thermosetting paint that is commonly used in this field, and that contains a base resin, a curing agent, and a medium comprising water and/or an organic solvent.

As the base resin and the curing agent, known compounds commonly used in this field can be used. Examples of the base resin include acrylic resins, polyester resins, epoxy resins, polyurethane resins, and the like. Examples of the curing agent include amino resins, polyisocyanate compounds, blocked polyisocyanate compounds, and the like. Usable examples of the organic solvent include methanol, ethanol, n-propyl alcohol, isopropyl alcohol, ethylene glycol, and the like.

In addition to the above components, the colored paint (W) used in the method of the present invention may suitably contain, if necessary, an ultraviolet absorber, an antifoaming agent, a thickener, a rust inhibitor, a surface adjusting agent, a pigment, and the like Examples of the pigment include coloring pigments, extender pigments, effect pigments, and the like. These can be used singly or in a combination of two or more.

Examples of the coloring pigments include titanium oxide, zinc flower, carbon black, molybdenum red, Prussian blue, cobalt blue, azo pigments, phthalocyanine pigments, quinacridone pigments, isoindoline pigments, threne pigments, perylene pigments, dioxazine pigments, diketopyrrolopyrrole pigments, and the like. Among these, titanium oxide and carbon black can be preferably used.

Examples of the extender pigments include clay, kaolin, barium sulfate, barium carbonate, calcium carbonate, talc, silica, alumina white, and the like. Among these, barium sulfate and/or talc are preferably used. In particular, it is preferable to use barium sulfate with an average primary particle size of 1 μm or less, and more preferably 0.01 to 0.8 μm, as the extender pigment to provide a multilayer coating film of appearance with excellent smoothness.

In the present specification, the average primary particle size of barium sulfate is determined by observing barium sulfate using a scanning electron microscope and averaging the maximum diameter of 20 barium sulfate particles on a straight line drawn at random on the electron microscope photograph.

Moreover, examples of the effect pigments include aluminum (including vapor-deposited aluminum), copper, zinc, brass, nickel, aluminum oxide, mica, titanium oxide- or iron oxide-coated aluminum oxide, titanium oxide- or iron oxide-coated mica, glass flakes, and holographic pigments. These effect pigments can be used singly or in a combination of two or more. Examples of aluminum pigments include non-leafing aluminum pigments and leafing aluminum pigments. Any of these pigments can be used.

When the colored paint (W) contains a pigment, the content of the pigment is generally within the range of 1 to 500 parts by mass, preferably 3 to 400 parts by mass, and more preferably 5 to 300 parts by mass, based on 100 parts by mass of the total resin solids content in the colored paint (W). In particular, it is preferable that the colored paint (W) contains a coloring pigment and/or an extender pigment, and that the total content of the coloring pigment and the extender pigment is generally within the range of 1 to 500 parts by mass, preferably 3 to 400 parts by mass, and particularly preferably 5 to 300 parts by mass, based on 100 parts by mass of the total resin solids content in the colored paint (W).

When the colored paint (W) contains a coloring pigment mentioned above, the content of the coloring pigment is generally within the range of 1 to 300 parts by mass, preferably 3 to 250 parts by mass, and more preferably 5 to 200 parts by mass, based on 100 parts by mass of the total resin solids content in the colored paint (W).

When the colored paint (W) contains an extender pigment mentioned above, the content of the extender pigment is generally within the range of 1 to 300 parts by mass, preferably 5 to 250 parts by mass, and even more preferably 10 to 200 parts by mass, based on 100 parts by mass of the total resin solids content in the colored paint (W).

When the colored paint (W) contains an effect pigment mentioned above, the content of the effect pigment is generally within the range of 0.1 to 50 parts by mass, preferably 0.2 to 30 parts by mass, and more preferably 0.3 to 20 parts by mass, based on 100 parts by mass of the total resin solids content in the colored paint (W).

Coating of the colored paint (W) having the above structure can improve the surface smoothness, impact resistance, and chipping resistance of the coated article.

As the coating method of the colored paint (W), general coating methods commonly used in this field can be used. Examples of the coating method include coating methods using a brush or a coating device. Among these, a coating method using a coating device is preferable. Preferable examples of the coating device include an airless spray coating device, an air spray coating device, and a rotary atomization electrostatic coating device, such as a paint cassette coating device; a rotary atomization electrostatic coating device is particularly preferable.

The colored coating film formed in this step is preferably a dried coating film obtained by applying the colored paint (W), followed by heating for curing, in terms of preventing the formation of a mixed layer between the colored coating film and a base coating film formed in step (2), described later. In this case, the heating temperature is preferably within the range of 110 to 180° C., and particularly preferably 120 to 160° C. Moreover, the heat treatment time is preferably within the range of 10 to 60 minutes, and particularly preferably 15 to 40 minutes.

The cured film thickness of the colored coating film after heat treatment under the above conditions is preferably within the range of 10 to 50 μm, and particularly preferably 15 to 40 μm, in terms of the impact resistance and chipping resistance of the coating film.

The monochrome hiding film thickness of the colored paint (W) is preferably 40 μm or less, more preferably 35 μm or less, and even more preferably 30 μm or less, in terms of the color stability of the multilayer coating film to be obtained. In the present specification, the "monochrome hiding film thickness" a value obtained in the following manner. The monochrome checkered hiding power test paper specified in 4.1.2 of JIS K5600-4-1 is attached to a steel plate. Then, the paint is applied by inclined coating so that the film thickness continuously varies, and the paint is dried or cured. The coating surface is then visually observed under diffused daylight, and the minimum film thickness in which the monochrome border of the checker of the hiding power test paper disappears is measured by an electromagnetic film thickness meter. The measured value is the "monochrome hiding film thickness."

When the colored coating film obtained in step (1) has coating film defect portions, such as dirt, seed, and orange peel, these can be removed. These coating defect portions can be removed by grinding the coating film with abrasive paper or an abrasive cloth by hand or using an instrument (sander) to which abrasive paper or an abrasive cloth is attached. Specifically, for example, the coating defect portions are first ground and removed using abrasive paper or an abrasive cloth containing a polishing material with a relatively rough particle size of about #400 to 600, and the ground surface is then made smooth using abrasive paper or an abrasive cloth containing a polishing material with a fine particle size of about #1000 to 1500. This is preferable to make the finished appearance of the multilayer coating film excellent. In order to remove powder of the coating film generated by grinding, it is preferable to wipe the coating surface with an organic solvent, such as gasoline, and to simultaneously perform degreasing. Grinding can be performed in the "spot range," that is, only in the above coating defect portions and neighboring portions thereof in the colored coating film; alternatively, the entire colored coating film can also be polished. Moreover, the grinding depth can be suitably selected according to the size, degree, and the like, of dirt and seed, and is generally within 50 μm, and particularly preferably about 10 to 30 μm.

2. Step (2)

Step (2) is to apply a base paint (X) to the colored coating film formed in step (1) to form a base coating film. In the present invention, the base paint (X) is an essential component for the multilayer coating film to exhibit undercoat hiding power.

Base Paint (X)

As the base paint, a known paint composition can be used. In particular, a paint composition generally used for coating of vehicle bodies is suitably used as the base paint.

The base paint (X) is preferably a paint containing a base resin, a curing agent, and a medium comprising water and/or an organic solvent.

As the base resin and the curing agent, known compounds commonly used in this field can be used.

The base resin is preferably a resin that has excellent weather resistance, transparency, and the like. Specific examples include acrylic resins, polyester resins, epoxy resins, urethane resins, and the like.

Examples of acrylic resins include resins obtained by copolymerizing monomer components, such as α,β-ethylenically unsaturated carboxylic acids, (meth)acrylic acid esters having a functional group, such as a hydroxyl group, an amide group, or a methylol group, other (meth)acrylic-acid esters, and styrene.

Usable examples of polyester resins include those obtained by the condensation reaction of polybasic acid, polyhydric alcohol, or denatured oil by a conventional method.

Examples of epoxy resins include an epoxy resin obtained by a method in which an epoxy ester is synthesized by the reaction of an epoxy group and an unsaturated fatty acid, and an α,β-unsaturated acid is added to this unsaturated group; an epoxy resin obtained by a method in which the hydroxyl group of epoxy ester and a polybasic acid, such as phthalic acid or trimellitic acid, are esterified; and the like.

Examples of urethane resins include urethane resins obtained by reacting at least one diisocyanate compound selected from the group consisting of an aliphatic diisocyanate compound, an alicyclic diisocyanate compound, and an aromatic diisocyanate compound, with at least one polyol compound selected from the group consisting of polyether polyol, polyester polyol, and polycarbonate polyol; urethane resins whose molecular weight is increased by reacting an acrylic resin, a polyester resin, or an epoxy resin mentioned above with a dipolyisocyanate compound; and the like.

The base paint (X) may be an aqueous paint or a solvent-based paint. However, in terms of reducing the VOC of the paint, the colored paint (X) is preferably an aqueous paint. When the base paint (X) is an aqueous paint, the base resin can be made soluble in water or dispersed in water by using a resin containing a hydrophilic group, such as a carboxyl group, a hydroxyl group, a methylol group, an amino group, a sulfonic acid group, or a polyoxyethylene group, most preferably a carboxyl group, in an amount sufficient for making the resin soluble in water or dispersed in water, and neutralizing the hydrophilic group to form an alkali salt. The amount of the hydrophilic group (e.g., a carboxyl group) used in this case is not particularly limited, and can be suitably selected depending on the degree of water solubilization or water dispersion. However, the amount of the hydrophilic group is generally such that the acid value is about 10 mgKOH/g or more, and preferably 30 to 200 mgKOH/g. Examples of the alkaline substance used in neutralization include sodium hydroxide, amine compounds, and the like.

Moreover, dispersion of the above resin in water can be performed by emulsion polymerization of the monomer components in the presence of a surfactant and optionally a water-soluble resin. Furthermore, the water dispersion can also be obtained by, for example, dispersing the above resin in water in the presence of an emulsifier. In the water dispersion, the base resin may not contain the above hydrophilic group at all, or may contain the above hydrophilic group in an amount less than the water-soluble resin.

The curing agent is used to crosslink and cure the base resin by heating. Examples include amino resins, polyisocyanate compounds (including unblocked polyisocyanate compounds and blocked polyisocyanate compounds), epoxy-containing compounds, carboxy-containing compounds, carbodiimide group-containing compounds, hydrazide group-containing compounds, semicarbazide group-containing compounds, and the like. Preferable among these are amino resins reactive with a hydroxyl group, polyisocyanate compounds, and carbodiimide group-containing compounds reactive with a carboxyl group. These curing agents can be used singly or in a combination of two or more.

Specifically, amino resins obtained by condensation or co-condensation of formaldehyde with melamine, benzoguanamine, urea, or the like, or further etherification with a lower monohydric alcohol, are suitably used. Further, a polyisocyanate compound can also be suitably used.

The ratio of each component in the base paint (X) may be freely selected as required. However, in terms of water resistance, finish, and the like, it is generally preferable that the ratio of the base resin is 50 to 90 mass %, and particularly 60 to 85 mass %, based on the total mass of both components; and that the ratio of the curing agent is 10 to 50 mass %, and particularly 15 to 40 mass %, based on the total mass of both components.

An organic solvent can also be used for the base paint (X), if necessary. Specifically, organic solvents generally used for paints can be used. Examples of organic solvents include hydrocarbons, such as toluene, xylene, hexane, and heptane; esters, such as ethyl acetate, butyl acetate, ethylene glycol monomethyl ether acetate, diethylene glycol monoethyl ether acetate, and diethylene glycol monobutyl acetate; ethers, such as ethylene glycol monomethyl ether, ethylene glycol diethyl ether, diethylene glycol monomethyl ether, and diethylene glycol dibutyl ether; alcohols, such as butanol, propanol, octanol, cyclohexanol, and diethylene glycol; ketones, such as methyl ethyl ketone, methyl isobutyl ketone, cyclohexanone, and isophorone; and other organic solvents. These can be used singly or in a combination of two or more.

In addition to the above components, the base paint (X) may suitably contain a coloring pigment, an extender pigment, an ultraviolet absorber, an antifoaming agent, a rheology control agent, a rust inhibitor, a surface adjusting agent, and the like, if necessary.

The base paint (X) is preferably a clear paint or a colored paint.

The base paint (X) being a clear paint means that the haze value of a dry film with a film thickness of 35 μm obtained by applying the base paint (X) is 25% or less. In the present invention, the haze value is defined as a value calculated using the following Equation (1) based on the diffuse light transmittance (DF) and parallel light transmittance (PT) of a coating film formed and cured on a smooth PTFE plate, and peeled off from the plate. The DF and PT of the coating film are measured using a Turbidimeter COH-300A (trade name, produced by Nippon Denshoku Industries Co., Ltd.).

$$\text{Haze value}=100*DF/(DF+PT) \quad (1)$$

When the base paint (X) is a clear paint, a coloring pigment is not contained, and an extender pigment can be contained, if necessary. Examples of extender pigments include barium sulfate, barium carbonate, calcium carbonate, aluminum silicate, silica, magnesium carbonate, talc, alumina white, and the like.

When the above extender pigment is mixed, the amount thereof is preferably within the range of 0.1 to 30 parts by mass, and more preferably 0.1 to 20 parts by mass, based on 100 parts by mass of the resin solids content in the base paint (X).

When the base paint (X) is a colored paint, a coloring pigment is contained. The base paint (X) can contain coloring pigments, such as titanium oxide and carbon black, in terms of control of light transmittance, and can further contain conventionally known coloring pigments other than titanium oxide and carbon black, if necessary. The coloring pigment is not particularly limited. Specific examples include composite metal oxide pigments, such as iron oxide pigments and titan yellow; azo pigments, quinacridone pigments, diketopyrrolopyrrole pigments, perylene pigments, perinone pigments, benzimidazolone pigments, isoindoline pigments, isoindolinone pigments, metal chelate azo pigments, phthalocyanine pigments, indanthrone pigments, dioxan pigments, threne pigments, indigo pigments, effect pigments, and the like. Any of these pigments can be used singly or in a combination of two or more. Examples of effect pigments include those mentioned in the "Colored Paint (W)" section.

When the above coloring pigment is mixed, the amount thereof is preferably within the range of 0.1 to 50 parts by mass, and more preferably 0.2 to 40 parts by mass, based on 100 parts by mass of the resin solids content in the base paint (X).

The cured film thickness of the base coating film obtained from the base paint (X) is preferably 3 μm or more, more preferably 3 to 20 μm, and even more preferably 5 to 15 μm, in terms of smoothness, metallic luster, and the like Coating of the base paint (X) can be performed by a general method. For example, air spray coating, airless spray coating, rotary atomization coating, and like methods can be used. An electrostatic charge may be applied, if necessary, during coating of the base paint (X). In particular, rotary atomization electrostatic coating and air spray electrostatic coating are preferable, and rotary atomization electrostatic coating is particularly preferable.

When air spray coating, airless spray coating, or rotary atomization coating is performed, the base paint (X) is preferably adjusted to have a solids content and viscosity suitable for coating by suitably adding water and/or an organic solvent, and optionally additives, such as rheology control agents and antifoaming agents.

The solids content of the base paint (X) is preferably within the range of 10 to 60 mass %, more preferably 15 to 55 mass %, and even more preferably of 20 to 50 mass %. The viscosity of the base paint (X) at 20° C. at 6 rpm measured by a Brookfield type viscometer is preferably within the range of 200 to 7000 cps, more preferably 300 to 6000 cps, and even more preferably 500 to 5000 cps.

3. Step (3)

Step (3) is to apply an effect pigment dispersion (Y) to the base coating film formed in step (2) to form an effect coating film.

Effect Pigment Dispersion (Y)

The effect pigment dispersion (Y) contains water, a surface adjusting agent (A), a flake-effect pigment (B), and a rheology control agent (C). The solids content of the effect pigment dispersion (Y) is 0.5 to 10 mass %, preferably 0.7 to 9 mass %, and more preferably 1 to 8 mass %, in terms of the metallic luster of the coating film to be obtained. In particular, when the flake-effect pigment (B) is a vapor deposition aluminum flake pigment, the solids content ratio of the effect pigment dispersion (Y) is preferably 1 to 5 mass %, in terms of ease of production.

Surface Adjusting Agent (A)

The surface adjusting agent (A) is used to facilitate uniform orientation of a flake-effect pigment (B), described later, dispersed in water on the substrate when the effect pigment dispersion (Y) is applied to the substrate.

As the surface adjusting agent (A), known surface adjusting agents can be used. In particular, the surface adjusting agent (A) is preferably one having a contact angle of preferably 8 to 20°, more preferably 9 to 19°, and even more preferably 10 to 18°, with respect to a previously degreased tin plate (produced by Paltek Corporation), the contact angle being measured in such a manner that a liquid that is a mixture of isopropanol, water, and the surface adjusting agent (A) at a ratio of 4.5/95/1 is adjusted to have a viscosity of 150 mPa·s measured by a Brookfield type viscometer at a rotor rotational speed of 60 rpm at a temperature of 20° C., 10 μL of the liquid is added dropwise to the tin plate, and the contact angle with respect to the tin plate is measured 10 seconds after dropping. Specifically, the viscosity is controlled by adding Acrysol ASE-60 (trade name, a polyacrylic acid-based rheology control agent, produced by The Dow Chemical Company, solids content: 28%) and dimethylethanolamine.

The 4.5/95/1 ratio, which is the mass ratio of isopropanol/water/surface adjusting agent (A), corresponds to the component ratio of the effect pigment dispersion (Y) for evaluating the surface adjusting agent. The 150 mPa-s viscosity measured by a Brookfield type viscometer at a rotor rotational speed of 60 rpm is a normal value during coating to a substrate. Moreover, the 8 to 20° contact angle with respect to the tin plate represents the wet spreading of liquid under standard coating conditions. When the contact angle is 8° or more, the liquid is applied to a substrate without being overly spread; whereas when the contact angle is 20° or less, the liquid is uniformly applied to a substrate without being overly repelled.

Examples of the surface adjusting agent (A) include silicone-based surface adjusting agents, acrylic-based surface adjusting agents, vinyl-based surface adjusting agents, and fluorine-based surface adjusting agents. These surface adjusting agents can be used singly or in a combination of two or more.

Examples of commercial products of the surface adjusting agent (A) include BYK series (produced by BYK-Chemie), Tego series (produced by Evonik), Glanol series and Polyflow series (produced by Kyoeisha Chemical Co., Ltd.), DISPARLON series (produced by Kusumoto Chemicals, Ltd.), and the like.

Usable silicone-based surface adjusting agents include polydimethylsiloxane and modified silicone obtained by modifying polydimethylsiloxane. Examples of modified silicone include polyether-modified silicone, acrylic-modified silicone, polyester-modified silicone, and the like.

The dynamic surface tension of the surface adjusting agent (A) is preferably 50 to 70 mN/m, more preferably 53 to 68 mN/m, and even more preferably 55 to 65 mN/m. In the present specification, the "dynamic surface tension" refers to a surface tension value measured by the maximum bubble pressure method at a frequency of 10 Hz. The dynamic surface tension was measured using a SITA measuring apparatus (SITA t60, produced by EKO Instruments).

Moreover, the static surface tension of the surface adjusting agent (A) is preferably 15 to 30 mN/m, more preferably 18 to 27 mN/m, and even more preferably 20 to 24 mN/m. In the present specification, the "static surface tension" refers to a surface tension value measured by the platinum ring method. The static surface tension was measured using a surface tensiometer (DCAT 21, produced by EKO Instruments).

Furthermore, the lamellar length of the surface adjusting agent (A) is preferably 6.0 to 9.0 mm, more preferably 6.5 to 8.5 mm, and even more preferably 7.0 to 8.0 mm.

The content of the surface adjusting agent (A) in the effect pigment dispersion (Y) as a solids content is preferably 0.01 to 4 parts by mass, more preferably 0.05 to 3 parts by mass, and even more preferably 0.1 to 2 parts by mass, based on 100 parts by mass of the effect pigment dispersion (Y), in terms of the excellent metallic luster of the multilayer coating film to be obtained.

Flake-Effect Pigment (B)

Examples of the flake-effect pigment (B) in the effect pigment dispersion (Y) include metal flake pigments, such as vapor deposition metal flake pigments, aluminum flake pigments, and colored aluminum flake pigments; interference pigments; and the like. Of these, vapor deposition metal flake pigments and aluminum flake pigments are preferable, in terms of obtaining a coating film with excellent metallic luster.

The vapor deposition metal flake pigment is obtained by vapor-depositing a metal film on a base material, removing the base material, and then grinding the vapor deposition metal film. Examples of the base material include films and the like.

The material of the above metal is not particularly limited. Examples include aluminum, gold, silver, copper, brass, titanium, chromium, nickel, nickel chromium, stainless steel, and the like. Of these, aluminum or chromium is particularly preferable, in terms of easy availability, ease of handling, and the like. In the present specification, a vapor deposition metal flake pigment obtained by vapor deposition of aluminum refers to a "vapor deposition aluminum flake pigment," and a vapor deposition metal flake pigment obtained by vapor deposition of chromium refers to a "vapor deposition chromium flake pigment."

Examples of commercial products that can be used as the vapor deposition aluminum flake pigment include "METALURE" series (trade name, produced by ECKART), "Hydroshine WS" series (trade name, produced by ECKART), "Decomet" series (trade name, produced by Schlenk), "Metasheen" series (trade name, produced by BASF), and the like.

Examples of commercial products that can be used as the vapor deposition chromium flake pigment include "Metalure Liquid Black" series (trade name, produced by ECKART) and the like.

The average thickness of the vapor deposition metal flake pigment is preferably 0.005 to 1 μm, and more preferably 0.01 to 0.1 μm.

The average particle size (D50) of the vapor deposition metal flake pigment is preferably 1 to 50 μm, and more preferably 5 to 20 μm. This is preferable in terms of the storage stability of the paint, and the excellent metallic luster of the coating film to be obtained. The above-mentioned average particle size means a major axis.

The surface of the vapor deposition aluminum flake pigment is preferably treated with silica, in terms of storage stability and the excellent metallic luster of the coating film to be obtained.

Aluminum flake pigments are generally produced by grinding or milling aluminum in a ball mill or an attritor mill in the presence of a grinding liquid medium using a grinding aid. Usable grinding aids include higher fatty acids, such as oleic acid, stearic acid, isostearic acid, lauric acid, palmitic acid, and myristic acid; as well as aliphatic amine, aliphatic amide, and aliphatic alcohol. As the grinding liquid medium, an aliphatic hydrocarbon, such as mineral spirit, is used. The grinding liquid medium may be replaced by a water-soluble solvent, such as alcohol, depending on chemical treatment after grinding.

Moreover, the aluminum flake pigment is desirably treated to inhibit reaction with water; in particular, the surface of the aluminum flake pigment is preferably treated with silica, in terms of storage stability and the excellent metallic luster of the coating film to be obtained.

The average thickness of the aluminum flake pigment is preferably 0.03 to 2 μm, and more preferably 0.05 to 1 μm.

The average particle size (D50) of the aluminum flake pigment is preferably about 1 to 50 μm, and more preferably about 5 to 20 μm. This is preferable in terms of the storage stability of the paint, and the excellent metallic luster of the coating film to be obtained. The above-mentioned average particle size means a major axis.

The content of the flake-effect pigment (B) in the effect pigment dispersion (Y) as a solids content is preferably 0.2 to 5 parts by mass, more preferably 0.3 to 4 parts by mass, and even more preferably 0.5 to 3 parts by mass, based on 100 parts by mass of the effect pigment dispersion (Y), in terms of the excellent metallic luster of the multilayer coating film to be obtained.

Rheology Control Agent (C)

As the rheology control agent (C) in the effect pigment dispersion of the present invention, a known rheology control agent can be used. Examples include silica-based fine powder, mineral-based rheology control agents, barium sulfate atomization powder, polyamide-based rheology control agents, organic resin fine particle rheology control agents, diurea-based rheology control agents, urethane association-type rheology control agents, polyacrylic acid-based rheology control agents, which are acrylic swelling-type, cellulose-based rheology control agents, and the like. Of these, particularly in terms of obtaining a coating film with excellent metallic luster, it is preferable to use a mineral-based rheology control agent, a polyacrylic acid-based rheology control agent, or a cellulose-based rheology control agent; and it is particularly preferable to use a cellulose-based rheology control agent. These rheology control agents can be used singly or in a combination of two or more.

Examples of mineral-based rheology control agents include swelling laminar silicate that has a 2:1 type crystal structure. Specific examples include smectite group clay minerals, such as natural or synthetic montmorillonite, saponite, hectorite, stevensite, beidellite, nontronite, bentonite, and laponite; swelling mica group clay minerals, such as Na-type tetrasilicic fluorine mica, Li-type tetrasilicic fluorine mica, Na salt-type fluorine taeniolite, and Li-type fluorine taeniolite; vermiculite; substitution products or derivatives thereof; and mixtures thereof.

Examples of polyacrylic acid-based rheology control agents include sodium polyacrylate, polyacrylic acid-(meth) acrylic acid ester copolymers, and the like.

Examples of commercial products of the polyacrylic acid-based rheology control agent include "Primal ASE-60," "Primal TT615," and "Primal RM5" (trade names, produced by The Dow Chemical Company); "SN Thickener 613," "SN Thickener 618," "SN Thickener 630," "SN Thickener 634," and "SN Thickener 636" (trade names, produced by San Nopco Limited); and the like. The acid value of the solids content of the polyacrylic acid-based rheology control agent is within the range of 30 to 300 mgKOH/g, and preferably 80 to 280 mgKOH/g.

Examples of cellulose-based rheology control agents include carboxymethylcellulose, methylcellulose, hydroxyethylcellulose, hydroxyethylmethylcellulose, hydroxypropylmethylcellulose, methylcellulose, cellulose nanofibers, and the like. Of these, cellulose nanofibers are particularly preferably used, in terms of obtaining a coating film with excellent metallic luster.

The cellulose nanofibers may also be referred to as cellulose nanofibrils, fibrillated cellulose, or nanocellulose crystals.

The cellulose nanofibers have a number average fiber diameter within the range of preferably 2 to 500 nm, more preferably 2 to 250 nm, even more preferably 2 to 150 nm, in terms of obtaining a coating film with excellent metallic luster. The cellulose nanofibers also have a number average fiber length within the range of preferably 0.1 to 20 μm, more preferably 0.1 to 15 μm, even more preferably 0.1 to 10 μm. The aspect ratio determined by dividing a number average fiber length by a number average fiber diameter is within the range of preferably 50 to 10000, more preferably 50 to 5000, and even more preferably 50 to 1000.

The number average fiber diameter and number average fiber length are measured and calculated from, for example, an image obtained by subjecting a sample (cellulose nanofibers diluted with water) to a dispersion treatment, casting the sample on a grid coated with a carbon film that has been subjected to hydrophilic treatment, and observing the sample with a transmission electron microscope (TEM).

The cellulose nanofibers for use may be those obtained by defibrating a cellulose material and stabilizing it in water. The cellulose material as used here refers to cellulose-main materials in various forms. Specific examples include pulp (e.g., grass plant-derived pulp, such as wood pulp, jute, Manila hemp, and kenaf); natural cellulose, such as cellulose produced by microorganisms; regenerated cellulose obtained by dissolving cellulose in a copper ammonia solution, a solvent of a morpholine derivative, or the like, and subjecting the dissolved cellulose to spinning; and fine cellulose obtained by subjecting the cellulose material to mechanical treatment, such as hydrolysis, alkali hydrolysis, enzymatic decomposition, blasting treatment, vibration ball milling, and the like, to depolymerize the cellulose.

The method for defibrating the cellulose material is not particularly limited, as long as the cellulose material remains in a fibrous form. Examples of the method include mechanical defibration treatment using a homogenizer, a grinder, and the like; chemical treatment using an oxidation catalyst and the like; and biological treatment using microorganisms and the like.

For the cellulose nanofibers, anionically modified cellulose nanofibers can be used. Examples of anionically modified cellulose nanofibers include carboxylated cellulose nanofibers, carboxymethylated cellulose nanofibers, and the like. The anionically modified cellulose nanofibers can be obtained, for example, by incorporating functional groups such as carboxyl groups and carboxymethyl groups into a cellulose material by a known method, washing the obtained modified cellulose to prepare a dispersion of the modified cellulose, and defibrating this dispersion. The carboxylated cellulose is also referred to as oxidized cellulose.

The oxidized cellulose is obtained, for example, by oxidizing the cellulose material in water using an oxidizing agent in the presence of a compound selected from the group consisting of N-oxyl compounds, bromide, iodide, and mixtures thereof.

The amount of an N-oxyl compound is not particularly limited, as long as the amount is a catalytic amount that can disintegrate cellulose into nanofibers. The amount of bromide or iodide can be suitably selected within the range in which an oxidation reaction is promoted.

For the oxidizing agent, a known oxidizing agent may be used. Examples include halogen, hypohalous acid, halous acid, perhalogenic acid, salts thereof, halogen oxide, peroxide, and the like. It is preferable to set the conditions so that the amount of carboxyl groups in oxidized cellulose is 0.2 mmol/g or more based on the solids content mass of the oxidized cellulose. The amount of carboxyl groups can be adjusted, for example, by performing the following: adjustment of oxidation reaction time; adjustment of oxidation reaction temperature; adjustment of pH in oxidation reaction; and adjustment of the amount of an N-oxyl compound, bromide, iodide, oxidizing agent, or the like.

The above carboxymethylated cellulose can be obtained, for example, in the following manner. The cellulose material and a solvent are mixed, and mercerization treatment is performed using 0.5 to 20-fold moles of alkali hydroxide metal per glucose residue of the cellulose material as a mercerization agent at a reaction temperature of 0 to 70° C. for a reaction time of about 15 minutes to 8 hours. Thereafter, 0.05 to 10.0-fold moles of a carboxymethylating agent per glucose residue is added thereto, followed by reaction at a reaction temperature of 30 to 90° C. for about 30 minutes to 10 hours.

The degree of substitution of carboxymethyl per glucose unit in the modified cellulose obtained by introducing carboxymethyl groups into the cellulose material is preferably 0.02 to 0.50.

The thus-obtained anion-modified cellulose can be dispersed in an aqueous solvent to form a dispersion, and the dispersion can be further defibrated. Although the defibration method is not particularly limited, when mechanical treatment is performed, the device to be used may be any of the following: a high-speed shearing device, a collider device, a bead mill device, a high-speed rotating device, a colloid mill device, a high-pressure device, a roll mill device, and an ultrasonic device. These devices may be used in a combination of two or more.

Examples of commercial products of cellulose nanofibers include Rheocrysta (registered trademark) produced by DKS Co. Ltd., and the like.

The cellulose-based rheology control agent in the effect pigment dispersion (Y) of the present invention is preferably contained in an amount of 2 to 150 parts by mass, and particularly preferably 3 to 120 parts by mass, based on 100 parts by mass of the flake-effect pigment, in terms of obtaining a coating film with excellent metallic luster.

The content of the rheology control agent (C) in the effect pigment dispersion (Y) as a solids content is preferably 0.01 to 3 parts by mass, more preferably 0.05 to 2 parts by mass, and even more preferably 0.1 to 1.5 parts by mass, based on 100 parts by mass of the effect pigment dispersion (Y), in terms of obtaining a coating film with excellent metallic luster.

Other Components

In particular, when the effect pigment dispersion (Y) contains a vapor deposition metal flake pigment or an aluminum flake pigment, it is preferable that the effect pigment dispersion (Y) contains a phosphate group-containing resin, in terms of the metallic luster and water resistance of the coating film to be obtained.

The phosphate group-containing resin can be produced by, for example, copolymerizing a phosphate group-containing polymerizable unsaturated monomer and other polymerizable unsaturated monomers by a known method, such as a solution-polymerization method. Examples of the phosphate group-containing polymerizable unsaturated monomer include acid phosphooxy ethyl(meth)acrylate, acid phosphooxy propyl(meth)acrylate, a reaction product of glycidyl (meth)acrylate and alkyl phosphoric acid, and the like. These can be used singly or in a combination of two or more.

In the phosphate group-containing resin, when the above phosphate group-containing polymerizable unsaturated monomer and another polymerizable unsaturated monomer are copolymerized, the ratio of each monomer used is such that the mass ratio of the former monomer to the latter monomer is preferably about 1/99 to 40/60, more preferably about 5/95 to 35/65, and even more preferably about 10/90 to 30/70.

The effect pigment dispersion (Y) may further suitably contain, if necessary, an organic solvent, a pigment other than the flake-effect pigment (B), a pigment dispersant, an antisettling agent, an antifoaming agent, an ultraviolet absorber, and the like.

The effect pigment dispersion (Y) may contain a base resin and/or a dispersion resin, in terms of the anti-water adhesion and/or storage stability of the coating film to be obtained. However, the effects of the present invention can be exhibited even if these resins are not substantially contained.

Examples of the base resin include acrylic resins, polyester resins, alkyd resins, urethane resins, and the like.

As the dispersion resin, existing dispersion resins, such as acrylic resins, epoxy resins, polycarboxylic acid resins, and polyester resins, can be used.

Crosslinkable Conponent (D)

The effect pigment dispersion (Y) may contain a crosslinkable component (D), in terms of the anti-water adhesion of the coating film to be obtained. In particular, when a clear paint (Z), described later, is a one-component clear paint and does not contain the crosslinkable component (D), it is preferable that the effect pigment dispersion (Y) contains the crosslinkable component (D).

In the present specification, the crosslinkable component (D) is selected from the group consisting of melamine, a melamine derivative, (meth)acrylamide, a copolymer of N-methylol group- or N-alkoxymethyl group-containing (meth) acrylamide, and a blocked or unblocked polyisocyanate compound.

Examples of melamine derivatives include partially etherified or fully etherified melamine resins produced by etherifying a part or all of methylol groups in methylolated melamine with a $C_{1-8}$ monohydric alcohol, such as methyl alcohol, ethyl alcohol, n-propyl alcohol, i-propyl alcohol, n-butyl alcohol, i-butyl alcohol, 2-ethylbutanol, or 2-ethylhexanol.

Examples of commercially available melamine derivatives include Cymel 202, Cymel 232, Cymel 235, Cymel 238, Cymel 254, Cymel 266, Cymel 267, Cymel 272, Cymel 285, Cymel 301, Cymel 303, Cymel 325, Cymel 327, Cymel 350, Cymel 370, Cymel 701, Cymel 703, and Cymel 1141 (all produced by Nihon Cytec Industries Inc.); U-Van 20SE60, U-Van 122, and U-Van 28-60 (all produced by Mitsui Chemicals, Inc.); Super Beckamine J-820-60, Super Beckamine L-127-60, and Super Beckamine G-821-60 (all produced by DIC); and the like. The above melamine and melamine derivatives can be used singly or in a combination of two or more.

Examples of the N-methylol group- or N-alkoxymethyl group-containing (meth) acrylamide include (meth) acrylamides, such as N-methylolacrylamide, N-methoxymethylacrylamide, N-methoxybutylacrylamide, and N-butoxymethyl (meth) acrylamide. The above (meth)acrylamide derivatives can be used singly or in a combination of two or more.

The unblocked polyisocyanate compound is a compound having at least two isocyanate groups per molecule. Examples include aliphatic polyisocyanates, alicyclic polyisocyanates, aliphatic-aromatic polyisocyanates, aromatic polyisocyanates, derivatives of these polyisocyanates, and the like.

Examples of aliphatic polyisocyanates include aliphatic diisocyanates, such as trimethylene diisocyanate, tetramethylene diisocyanate, hexamethylene diisocyanate, pentamethylene diisocyanate, 1,2-propylene diisocyanate, 1,2-butylene diisocyanate, 2,3-butylene diisocyanate, 1,3-butylene diisocyanate, 2,4,4- or 2,2,4-trimethylhexamethylene diisocyanate, dimer acid diisocyanate, and methyl 2,6-diisocyanatohexanoate (common name: lysine diisocyanate); aliphatic triisocyanates, such as 2-isocyanatoethyl 2,6-diisocyanatohexanoate, 1,6-diisocyanato-3-isocyanatomethylhexane, 1,4,8-triisocyanatooctane, 1,6,11-triisocyanatoundecane, 1,8-diisocyanato-4-isocyanatomethyloctane, 1,3,6-triisocyanatohexane, and 2,5,7-trimethyl-1,8-diisocyanato-5-isocyanatomethyloctane; and the like.

Examples of alicyclic polyisocyanates include alicyclic diisocyanates, such as 1,3-cyclopentene diisocyanate, 1,4-cyclohexane diisocyanate, 1,3-cyclohexane diisocyanate, 3-isocyanatomethyl-3,5,5-trimethylcyclohexyl isocyanate (common name: isophorone diisocyanate), 4-methyl-1,3-cyclohexylene diisocyanate (common name: hydrogenated TDI), 2-methyl-1,3-cyclohexylene diisocyanate, 1,3- or 1,4-bis(isocyanatomethyl)cyclohexane (common name: hydrogenated xylylene diisocyanate) or mixtures thereof, and methylenebis(4,1-cyclohexanediyl)diisocyanate (common name: hydrogenated MDI), and norbornane diisocyanate; alicyclic triisocyanates, such as 1,3,5-triisocyanatocyclohexane, 1,3,5-trimethylisocyanatocyclohexane, 2-(3-isocyanatopropyl)-2,5-di (isocyanatomethyl)-bicyclo(2.2.1) heptane, 2-(3-isocyanatopropyl)-2,6-di (isocyanatomethyl)-bicyclo(2.2.1) heptane, 3-(3-isocyanatopropyl)-2,5-di (isocyanatomethyl)-bicyclo (2.2.1)heptane, 5-(2-isocyanatoethyl)-2-isocyanatomethy-3-(3-isocyanatopropyl)-bicyclo(2.2.1) heptane, 6-(2-isocyanatoethyl)-2-isocyanatomethyl-3-(3-isocyanatopropyl)-bicyclo (2.2.1) heptane, 5-(2-isocyanatoethyl)-2-isocyanatomethyl-2-(3-isocyanatopropyl)-bicyclo (2.2.1)heptane, and 6-(2-isocyanatoethyl)-2-isocyanatomethyl-2-(3-isocyanatopropyl)-bicyclo (2.2.1)heptane; and the like.

Examples of aromatic-aliphatic polyisocyanates include aromatic-aliphatic diisocyanates, such as methylenebis(4,1-phenylene)diisocyanate (cammon name: MDI), 1,3- or 1,4-xylylene diisocyanate or mixtures thereof, ω,ω'-diisocyanato-1,4-diethylbenzene, and 1,3- or 1,4-bis(1-isocyanato-1-methylethyl)benzene (conmon name: tetramethylxylylene diisocyanate) or mixtures thereof; aromatic-aliphatic triisocyanates, such as 1,3,5-triisocyanatomethylbenzene; and the like.

Examples of aromatic polyisocyanates include aromatic diisocyanates, such as m-phenylene diisocyanate, p-phenylene diisocyanate, 4,4'-diphenyl diisocyanate, 1,5-naphthalene diisocyanate, 2,4-tolylene diisocyanate (common name: 2,4-TDI), or 2,6-tolylene diisocyanate (common name: 2,6-TDI) or mixtures thereof, 4,4'-toluidine diisocyanate, and 4,4'-diphenylether diisocyanate; aromatic triisocyanates, such as triphenylmethane-4,4',4"-triisocyanate, 1,3,5-triisocyanatobenzene, and 2,4,6-triisocyanatotoluene; aromatic tetraisocyanates, such as 4,4'-diphenylmethane-2,2',5,5'-tetraisocyanate; and the like.

Examples of polyisocyanate derivatives include dimers, trimers, biurets, allophanates, urethodiones, urethoimines, isocyanurates, oxadiazinetriones, polymethylene polyphenyl polyisocyanates (crude MDI, polymeric MDI), crude TDI, and the like, of the above-mentioned polyisocyanates. These polyisocyanate derivatives may be used singly or in a combination of two or more. The above polyisocyanates and derivatives thereof may be used singly or in a combination of two or more.

Among the aliphatic diisocyanates, hexamethylene diisocyanate or derivatives thereof are preferably used, and among the alicyclic diisocyanates, 4,4'-methylenebis(cyclohexyl isocyanate) is preferably used. Of these, derivatives of hexamethylene diisocyanate are particularly the most preferable, in terms of adhesion, compatibility, and the like.

As the polyisocyanate compound, it is also possible to use a prepolymer formed by reacting the polyisocyanate or a derivative thereof with a compound having active hydrogen, such as hydroxy or amino, and reactive to the polyisocyanate under conditions such that the isocyanate groups are present in excess. Examples of the compound reactive to the polyisocyanate include polyhydric alcohols, low-molecular-weight polyester resins, amine, water, and the like. The above polyisocyanate compounds can be used singly or in a combination of two or more.

The blocked polyisocyanate compound is a blocked polyisocyanate compound in which some or all of the isocyanate groups of the above polyisocyanate or a derivative thereof are blocked with a blocking agent.

Examples of the blocking agent include phenol-based blocking agents, lactam-based blocking agents, aliphatic alcohol-based blocking agents, ether-based blocking agents, alcohol-based blocking agents, oxime-based blocking agents, active methylene-based blocking agents, mercaptan-based blocking agents, acid amide-based blocking agents, imide-based blocking agents, amine-based blocking agents, imidazole-based blocking agents, urea-based blocking agents, carbamate-based blocking agents, imine-based blocking agents, sulfite-based blocking agents, azole-based compounds, and the like.

Examples of phenol-based blocking agents include phenol, cresol, xylenol, nitrophenol, ethylphenol, hydroxydiphenyl, butylphenol, isopropylphenol, nonylphenol, octylphenol, and methyl hydroxybenzoate.

Examples of lactam-based blocking agents include s-caprolactam, δ-valerolactam, γ-butyrolactam, and β-propiolactam.

Examples of aliphatic alcohol-based blocking agents include methanol, ethanol, propyl alcohol, butyl alcohol, amyl alcohol, and lauryl alcohol.

Examples of ether-based blocking agents include ethylene glycol monomethyl ether, ethylene glycol monoethyl ether, ethylene glycol monobutyl ether, diethylene glycol monomethyl ether, diethylene glycol monoethyl ether, propylene glycol monomethyl ether, and methoxymethanol.

Examples of alcohol-based blocking agents include benzyl alcohol, glycolic acid, methyl glycolate, ethyl glycolate, butyl glycolate, lactic acid, methyl lactate, ethyl lactate, butyl lactate, methylol urea, methylol melamine, diacetone alcohol, 2-hydroxyethyl acrylate, and 2-hydroxyethyl methacrylate.

Examples of oxime-based blocking agents include formamide oxime, acetamide oxime, acetoxime, methyl ethyl ketoxime, diacetyl monoxime, benzophenone oxime, and cyclohexane oxime.

Examples of active methylene-based blocking agents include dimethyl malonate, diethyl malonate, ethyl acetoacetate, methyl acetoacetate, and acetylacetone.

Examples of mercaptan-based blocking agents include butyl mercaptan, t-butyl mercaptan, hexyl mercaptan, t-dodecyl mercaptan, 2-mercaptobenzothiazole, thiophenol, methylthiophenol, and ethylthiophenol.

Examples of acid amide-based blocking agents include acetanilide, acetanisidide, acetotoluide, acrylamide, methacrylamide, acetic acid amide, stearic acid amide, and benzamide.

Examples of imide-based blocking agents include succinimide, phthalimide, and maleimide.

Examples of amine-based blocking agents include diphenylamine, phenylnaphthylamine, xylidine, N-phenylxylidine, carbazole, aniline, naphthylamine, butylamine, dibutylamine, and butylphenylamine.

Examples of imidazole-based blocking agents include imidazole and 2-ethylimidazole.

Examples of urea-based blocking agents include urea, thiourea, ethyleneurea, ethylenethiourea, and diphenylurea.

Examples of carbamate-based blocking agents include phenyl N-phenylcarbamate.

Examples of imine-based blocking agents include ethyleneimine and propyleneimine.

Examples of sulfite-based blocking agents include sodium bisulfite and potassium bisulfite.

Examples of azole-based compounds include pyrazole or pyrazole derivatives, such as pyrazole, 3,5-dimethylpyrazole, 3-methylpyrazole, 4-benzyl-3,5-dimethylpyrazole, 4-nitro-3,5-dimethylpyrazole, 4-bromo-3,5-dimethylpyrazole, and 3-methyl-5-phenylpyrazole; imidazole or imidazole derivatives, such as imidazole, benzimidazole, 2-methylimidazole, 2-ethylimidazole, and 2-phenylimidazole; and imidazoline derivatives, such as 2-methylimidazoline and 2-phenylimidazoline.

When blocking is performed (a blocking agent is reacted), it can be performed by adding a solvent, if necessary. As the solvent used in the blocking reaction, a solvent that is not reactive with an isocyanate group is preferably used. Examples include ketones, such as acetone and methyl ethyl ketone; esters, such as ethyl acetate; N-methyl-2-pyrrolidone (NMP); and like solvents. The above blocked polyisocyanate compounds can be used singly or in a combination of two or more.

When the effect pigment dispersion (Y) contains a cross-linkable component (D), the content thereof as a solids content is preferably within the range of 1 to 100 parts by mass, more preferably 5 to 95 parts by mass, and even more preferably 10 to 90 parts by mass, based on 100 parts by mass of the solids content of the flake-effect pigment (B) in the effect pigment dispersion (Y), in terms of the anti-water adhesion of the coating film.

When the effect pigment dispersion (Y) contains a base resin and a dispersion resin described above, and further contains a crosslinkable component (D), the total amount as a solids content of the base resin, the dispersion resin, and the crosslinkable component (D) is, in terms of forming a coating film with metallic luster, preferably within the range of 1 to 500 parts by mass, more preferably 5 to 300 parts by mass, and even more preferably 10 to 100 parts by mass, based on 100 parts by mass of the solids content of the flake-effect pigment (B) in the effect pigment dispersion (Y), in terms of the anti-water adhesion of the coating film.

Contact Angle of Effect Pigment Dispersion (Y)

The contact angle of the effect pigment dispersion (Y) is preferably 8 to 20°, and more preferably 10 to 18°, in terms of obtaining a coating film with excellent metallic luster. The contact angle meter used in this case is CA-X150 (produced by Kyowa Interface Science Co., Ltd.). The viscosity of the effect pigment dispersion (Y) measured by a Brookfield type viscometer at a rotor rotational speed of 60 rpm is adjusted to 150 mPa·s, 10 μL is added dropwise to a previously degreased tin plate (produced by Paltek Corporation), and the viscosity is measured 10 seconds after dropping. The measured value refers to the contact angle.

Coating of Effect Pigment Dispersion (Y)

In the coating of the effect pigment dispersion (Y), the viscosity of the effect pigment dispersion (Y) at a temperature of 20° C. measured by a Brookfield type viscometer at 60 rpm after 1 minute (also referred to as "the B60 value" in the present specification) is preferably 60 to 2000 mPa·s, more preferably 60 to 1500 mPa·s, and even more preferably 60 to 1000 mPa·s, in terms of obtaining a coating film with excellent metallic luster. The viscometer used in this case is a Brookfield type viscometer (trade name: LVDV-I, produced by Brookfield).

The effect pigment dispersion (Y) can be applied by a method such as electrostatic coating, air spray coating, or airless spray coating. In the method for forming a multilayer coating film of the present invention, rotary atomization electrostatic coating is particularly preferable.

It is preferable that the effect coating film obtained by applying the effect pigment dispersion (Y) is dried. The method of drying the effect coating film is not particularly limited. For example, a method that allows the coating film to stand at ordinary temperature for 15 to 30 minutes, a method that performs preheating at a temperature of 50 to 100° C. for 30 seconds to 10 minutes, or the like, can be used.

The film thickness 30 seconds after the effect pigment dispersion (Y) is attached to the substrate is preferably 3 to 50 μm, more preferably 4 to 40 μm, and even more preferably 5 to 30 μm, in terms of obtaining a coating film with excellent metallic luster.

The thickness of the effect coating film, as dry film thickness, is preferably 0.02 to 5 μm, more preferably 0.02 to 4 μm, and even more preferably 0.02 to 3.5 μm, in terms of obtaining a coating film with excellent metallic luster.

In particular, when the flake-effect pigment (B) in the effect pigment dispersion (Y) is a vapor deposition metal flake pigment, the thickness of the effect coating film, as dry film thickness, is preferably 0.02 to 2 μm, and more preferably 0.05 to 1.5 μm, in terms of obtaining a coating film with excellent metallic luster.

In particular, when the flake-effect pigment (B) in the effect pigment dispersion (Y) is an aluminum flake pigment, the thickness of the effect coating film, as dry film thickness, is preferably 0.05 to 5 μm, more preferably 0.1 to 4 μm, and even more preferably 0.15 to 3.5 μm, in terms of obtaining a coating film with excellent metallic luster.

In the present specification, the dry film thickness is calculated from the following formula (2):

$$x=(sc*10000)/(S*sg) \quad (2)$$

x: film thickness [μm]
sc: coating solids content [g]
S: evaluation area of coating solids content [$cm^2$]
sg: coating film specific gravity [$g/cm^3$]

4. Step (4)

Step (4) is to apply a clear paint (Z) to the effect coating film formed in step (3) to form a clear coating film.

Clear Paint (Z)

The clear paint (Z) may be a one-component clear paint containing a base resin and a curing agent, or a two-component clear paint having a hydroxy-containing resin and a polyisocyanate compound.

The clear paint (Z) is preferably a two-component clear paint having a hydroxy-containing resin and an isocyanate group-containing compound, in terms of the anti-water adhesion and metallic luster of the multilayer coating film to be obtained.

Hydroxy-Containing Resin

As the hydroxy-containing resin, conventionally known resins can be used without limitation, as long as they are resins containing a hydroxyl group. Examples of the hydroxy-containing resin include hydroxy-containing acrylic resins, hydroxy-containing polyester resins, hydroxy-containing polyether resins, hydroxy-containing polyurethane resins, and the like; preferably hydroxy-containing acrylic resins and hydroxy-containing polyester resins; and particularly preferably hydroxy-containing acrylic resins.

The hydroxy value of the hydroxy-containing acrylic resin is preferably within the range of 80 to 200 mgKOH/g, and more preferably 100 to 180 mgKOH/g. When the hydroxy value is 80 mgKOH/g or more, the crosslinking density is high, and thus the scratch resistance is sufficient. Further, when the hydroxy value is 200 mgKOH/g or less, the water resistance of the coating film is satisfied.

The weight average molecular weight of the hydroxy-containing acrylic resin is preferably within the range of 2500 to 40000, and more preferably 5000 to 30000. When the weight average molecular weight is 2500 or more, the coating film performance, such as acid resistance, is satisfied. When the weight average molecular weight is 40000 or less, the smoothness of the coating film is sufficient, and thus the finish is satisfied.

In the present specification, the weight average molecular weight refers to a value calculated from a chromatogram measured by gel permeation chromatography based on the molecular weight of standard polystyrene. For the gel permeation chromatography, "HLC8120GPC" (produced by Tosoh Corporation) was used. The measurement was conducted using four columns: "TSKgel G-4000HXL," "TSKgel G-3000HXL," "TSKgel G-2500HXL," and "TSKgel G-2000HXL" (trade names, all produced by Tosoh Corporation) under the following conditions: mobile phase: tetrahydrofuran, measuring temperature: 40° C., flow rate: 1 cc/min, and detector: RI.

The glass transition temperature of the hydroxy-containing acrylic resin is −40° C. to 20° C., and particularly preferably −30° C. to 10° C. When the glass transition temperature is −40° C. or more, the coating film hardness is sufficient. When the glass transition temperature is 20° C. or less, the coating surface smoothness of the coating film is satisfied.

Polyisocyanate Compound

A polyisocyanate compound is a compound having at least two isocyanate groups per molecule. Examples include aliphatic polyisocyanates, alicyclic polyisocyanates, aliphatic-aromatic polyisocyanates, aromatic polyisocyanates, derivatives of these polyisocyanates, and the like.

Examples of aliphatic polyisocyanates include aliphatic diisocyanates, such as trimethylene diisocyanate, tetramethylene diisocyanate, hexamethylene diisocyanate, pentamethylene diisocyanate, 1,2-propylene diisocyanate, 1,2-butylene diisocyanate, 2,3-butylene diisocyanate, 1,3-butylene diisocyanate, 2,4,4- or 2,2,4-trimethylhexamethylene diisocyanate, dimer acid diisocyanate, and methyl 2,6-diisocyanatohexanoate (common name: lysine diisocyanate); aliphatic triisocyanates, such as 2-isocyanatoethyl 2,6-diisocyanatohexanoate, 1,6-diisocyanato-3-isocyanatomethylhexane, 1,4,8-triisocyanatooctane, 1,6,11-triisocyanatoundecane, 1,8-diisocyanato-4-isocyanatomethyloctane, 1,3,6-triisocyanatohexane, and 2,5,7-trimethyl-1,8-diisocyanato-5-isocyanatomethyloctane; and the like.

Examples of alicyclic polyisocyanates include alicyclic diisocyanates, such as 1,3-cyclopentene diisocyanate, 1,4-cyclohexane diisocyanate, 1,3-cyclohexane diisocyanate, 3-isocyanatomethyl-3,5,5-trimethylcyclohexyl isocyanate (common name: isophorone diisocyanate), 4-methyl-1,3-cyclohexylene diisocyanate (common name: hydrogenated TDI), 2-methyl-1,3-cyclohexylene diisocyanate, 1,3- or 1,4-bis(isocyanatomethyl)cyclohexane (common name: hydrogenated xylylene diisocyanate) or mixtures thereof, and methylenebis(4,1-cyclohexanediyl)diisocyanate (common name: hydrogenated MDI), and norbornane diisocyanate; alicyclic triisocyanates, such as 1,3,5-triisocyanatocyclohexane, 1,3,5-trimethylisocyanatocyclohexane, 2-(3-isocyanatopropyl)-2,5-di (isocyanatomethyl)-bicyclo (2.2.1) heptane, 2-(3-isocyanatopropyl)-2,6-di (isocyanatomethyl)-bicyclo (2.2.1) heptane, 3-(3-isocyanatopropyl)-2,5-di (isocyanatomethyl)-bicyclo (2.2.1)heptane, 5-(2-isocyanatoethyl)-2-isocyanatomethy-3-(3-isocyanatopropyl)-bicyclo (2.2.1) heptane, 6-(2-isocyanatoethyl)-2-isocyanatomethyl-3-(3-isocyanatopropyl)-bicyclo(2.2.1)heptane, 5-(2-isocyanatoethyl)-2-isocyanatomethyl-2-(3-isocyanatopropyl)-bicyclo(2.2.1)heptane, and 6-(2-isocyanatoethyl)-2-isocyanatomethyl-2-(3-isocyanatopropyl)-bicyclo (2.2.1)heptane; and the like.

Examples of aliphatic-aromatic polyisocyanates include aliphatic-aromatic diisocyanates, such as methylenebis(4,1-phenylene)diisocyanate (connon name: MDI), 1,3- or 1,4-xylylene diisocyanate or mixtures thereof, ω,ω'-diisocyanato-1,4-diethylbenzene, and 1,3- or 1,4-bis(1-isocyanato-1-methylethyl)benzene (comnon name: tetramethylxylylene diisocyanate) or mixtures thereof; aliphatic-aromatic triisocyanates, such as 1,3,5-triisocyanatomethylbenzene; and the like.

Examples of aromatic polyisocyanates include aromatic diisocyanates, such as m-phenylene diisocyanate, p-phenylene diisocyanate, 4,4'-diphenyl diisocyanate, 1,5-naphthalene diisocyanate, 2,4-tolylene diisocyanate (common name: 2,4-TDI), or 2,6-tolylene diisocyanate (common name: 2,6-TDI) or mixtures thereof, 4,4'-toluidine diisocyanate, and 4,4'-diphenylether diisocyanate; aromatic triisocyanates, such as triphenylmethane-4,4',4"-triisocyanate, 1,3,5-triisocyanatobenzene, and 2,4,6-triisocyanatotoluene; aromatic tetraisocyanates, such as 4,4'-diphenylmethane-2,2',5,5'-tetraisocyanate; and the like.

Examples of polyisocyanate derivatives include dimers, trimers, biurets, allophanates, urethodiones, urethoimines, isocyanurates, oxadiazinetriones, polymethylene polyphenyl polyisocyanates (crude MDI, polymeric MDI), crude TDI, and the like, of the above-mentioned polyisocyanates. These polyisocyanate derivatives may be used singly or in a combination of two or more. The above polyisocyanates and derivatives thereof may be used singly or in a combination of two or more.

Among the aliphatic diisocyanates, hexamethylene diisocyanate or derivatives thereof are preferably used, and among the alicyclic diisocyanates, 4,4'-methylenebis(cyclohexyl isocyanate) is preferably used. Of these, derivatives of hexamethylene diisocyanate are particularly the most preferable, in terms of adhesion, compatibility, and the like.

As the polyisocyanate compound, a prepolymer is also usable that is formed by reacting the polyisocyanate or a derivative thereof with a compound having active hydrogen, such as hydroxy or amino, and reactive to the polyisocyanate under conditions such that the isocyanate groups are present in excess. Examples of the compound reactive to the polyisocyanate include polyhydric alcohols, low-molecular-weight polyester resins, amine, water, and the like.

The polyisocyanate compound for use may be a blocked polyisocyanate compound in which some or all of the isocyanate groups of the above polyisocyanate or a derivative thereof are blocked with a blocking agent.

Examples of the blocking agent include phenol-based blocking agents, lactam-based blocking agents, aliphatic alcohol-based blocking agents, ether-based blocking agents, alcohol-based blocking agents, oxime-based blocking agents, active methylene-based blocking agents, mercaptan-based blocking agents, acid amide-based blocking agents, imide-based blocking agents, amine-based blocking agents, imidazole-based blocking agents, urea-based blocking agents, carbamate-based blocking agents, imine-based blocking agents, sulfite-based blocking agents, azole-based compounds, and the like.

Examples of phenol-based blocking agents include phenol, cresol, xylenol, nitrophenol, ethylphenol, hydroxydiphenyl, butylphenol, isopropylphenol, nonylphenol, octylphenol, and methyl hydroxybenzoate.

Examples of lactam-based blocking agents include ε-caprolactam, δ-valerolactam, γ-butyrolactam, and β-propiolactam.

Examples of aliphatic alcohol-based blocking agents include methanol, ethanol, propyl alcohol, butyl alcohol, amyl alcohol, and lauryl alcohol.

Examples of ether-based blocking agents include ethylene glycol monomethyl ether, ethylene glycol monoethyl ether, ethylene glycol monobutyl ether, diethylene glycol monomethyl ether, diethylene glycol monoethyl ether, propylene glycol monomethyl ether, and methoxymethanol.

Examples of alcohol-based blocking agents include benzyl alcohol, glycolic acid, methyl glycolate, ethyl glycolate, butyl glycolate, lactic acid, methyl lactate, ethyl lactate, butyl lactate, methylol urea, methylol melamine, diacetone alcohol, 2-hydroxyethyl acrylate, and 2-hydroxyethyl methacrylate.

Examples of oxime-based blocking agents include formamide oxime, acetamide oxime, acetoxime, methyl ethyl ketoxime, diacetyl monoxime, benzophenone oxime, and cyclohexane oxime.

Examples of active methylene-based blocking agents include dimethyl malonate, diethyl malonate, ethyl acetoacetate, methyl acetoacetate, and acetylacetone.

Examples of mercaptan-based blocking agents include butyl mercaptan, t-butyl mercaptan, hexyl mercaptan, t-dodecyl mercaptan, 2-mercaptobenzothiazole, thiophenol, methylthiophenol, and ethylthiophenol.

Examples of acid amide-based blocking agents include acetanilide, acetanisidide, acetotoluide, acrylamide, methacrylamide, acetic acid amide, stearic acid amide, and benzamide.

Examples of imide-based blocking agents include succinimide, phthalimide, and maleimide.

Examples of amine-based blocking agents include diphenylamine, phenylnaphthylamine, xylidine, N-phenylxylidine, carbazole, aniline, naphthylamine, butylamine, dibutylamine, and butylphenylamine.

Examples of imidazole-based blocking agents include imidazole and 2-ethylimidazole.

Examples of urea-based blocking agents include urea, thiourea, ethyleneurea, ethylenethiourea, and diphenylurea. Examples of carbamate-based blocking agents include phenyl N-phenylcarbamate.

Examples of imine-based blocking agents include ethyleneimine and propyleneimine.

Examples of sulfite-based blocking agents include sodium bisulfite and potassium bisulfite.

Examples of azole-based compounds include pyrazole or pyrazole derivatives, such as pyrazole, 3,5-dimethylpyrazole, 3-methylpyrazole, 4-benzyl-3,5-dimethylpyrazole, 4-nitro-3,5-dimethylpyrazole, 4-bramo-3,5-dimethylpyrazole, and 3-methyl-5-phenylpyrazole; imidazole or imidazole derivatives, such as imidazole, benzimidazole, 2-methylimidazole, 2-ethylimidazole, and 2-phenylimidazole; and imidazoline derivatives, such as 2-methylimidazoline and 2-phenylimidazoline.

When blocking is performed (a blocking agent is reacted), it can be performed by adding a solvent, if necessary. As the solvent used in the blocking reaction, a solvent that is not reactive with an isocyanate group is preferably used. Examples include ketones, such as acetone and methyl ethyl ketone; esters, such as ethyl acetate; N-methyl-2-pyrrolidone (NMP); and like solvents. The polyisocyanate compounds can be used singly or in a combination of two or more.

In the two-component clear paint of the present invention, the equivalent ratio of the hydroxy groups in the hydroxy-containing resin to the isocyanate groups in the polyisocyanate compound (NCO/OH) is preferably within the range of 0.5 to 2.0, and more preferably 0.8 to 1.5, in terms of the curability, scratch resistance, and the like, of the coating film.

Examples of combinations of a base resin and a curing agent in the one-component clear paint include a carboxy-containing resin and an epoxy-containing resin, a hydroxy-containing resin and a blocked polyisocyanate compound, a hydroxy-containing resin and a melamine resin, and the like. When a one-component paint is used as the clear paint (Z), the clear paint (Z) preferably contains a crosslinkable component (D) in terms of the anti-water adhesion of the coating film to be obtained. In particular, when the effect pigment dispersion (Y) does not contain the crosslinkable component (D), the clear paint (Z) preferably contains the crosslinkable component (D).

As the crosslinkable component (D), those described in the "Effect Pigment Dispersion (Y)" section can be used.

When the clear paint (Z) contains the crosslinkable component (D), the content thereof as a solids content is preferably within the range of 5 to 60 parts by mass, more preferably 10 to 50 parts by mass, and even more preferably 15 to 40 parts by mass, based on 100 parts by mass of the resin solids content of the clear paint (Z), in terms of the anti-water adhesion of the coating film.

The clear paint (Z) may suitably contain additives, such as solvents (e.g., water and organic solvents), curing catalysts, antifoaming agents, and ultraviolet absorbers, if necessary.

The clear paint (Z) may suitably contain a coloring pigment within a range that does not impair transparency. As the coloring pigment, conventionally known pigments for ink or paints can be used singly or in a combination of two or more. The amount thereof to be added may be suitably determined, but is preferably 30 parts by mass or less, and more preferably 0.01 to 10 parts by mass, based on 100 parts by mass of the vehicle-forming resin composition in the clear paint (Z).

The form of the clear paint (Z) is not particularly limited. The clear paint (Z) is generally used as an organic solvent-based paint composition. Examples of the organic solvent used in this case include various organic solvents for paints, such as aromatic or aliphatic hydrocarbon solvents, ester solvents, ketone solvents, ether solvents, and the like. As the organic solvent used herein, the one used in the preparation of the hydroxy-containing resin may be used as is, or other organic solvents may be further suitably added.

The solids concentration of the clear paint (Z) is preferably about 30 to 70 mass %, and more preferably about 40 to 60 mass %.

The clear paint (Z) is applied to the effect coating film. The coating of the clear paint (Z) is not particularly limited, and the same method as those for the colored paint (X) and the effect pigment dispersion (Y) may be used. For example, the clear paint (Z) can be applied by a coating method, such as air spray coating, airless spray coating, rotary atomization coating, or curtain coating. In these coating methods, an electrostatic charge may be applied, if necessary. Among these, rotary atomization coating using an electrostatic charge is preferable. The coating amount of the clear paint (Z) is generally preferably an amount in which the cured film thickness is about 10 to 50 μm.

Moreover, when the clear paint (Z) is applied, it is preferable to suitably adjust the viscosity of the clear paint (Z) within a viscosity range suitable for the coating method. For example, for rotary atomization coating using an electrostatic charge, it is preferable to suitably adjust the viscosity of the clear paint (Z) within a range of about 15 to 60 seconds measured by a Ford cup No. 4 viscometer at 20° C. using a solvent, such as an organic solvent.

After the clear paint (Z) is applied to form a clear coating film, for example, preheating can be performed at a temperature of about 50 to 80° C. for about 3 to 10 minutes so as to promote the vaporization of volatile components.

5. Step (5)

Step (5) is to heat the uncured base coating film, the uncured effect coating film, and the uncured clear coating film formed in steps (2) to (4) to simultaneously cure these three coating films.

Heating can be performed by a known means. For example, a drying furnace, such as a hot-blast stove, an electric furnace, or an infrared beam heating furnace, can be used. The heating temperature is preferably within the range of 70 to 150° C., and more preferably 80 to 140° C. The heating time is not particularly limited, but is preferably within the range of 10 to 40 minutes, and more preferably 20 to 30 minutes.

The multilayer coating film obtained in the present invention has excellent metallic luster and anti-water adhesion. In the present specification, metallic luster is evaluated according to specular reflectance and graininess.

Specular reflectance is expressed by 60° gloss values measured according to JIS K-5400 7.6 (1990).

The graininess is evaluated as a hi-light graininess value (hereinafter abbreviated as the "HG value"). The HG value is a parameter of micro-brilliance obtained by microscopic observation, and indicates the graininess in the highlight (observation of the coating film from near the specular reflection light against incident light). The HG value is calculated as follows. First, the coating film is photographed with a CCD camera at a light incidence angle of 15° and a receiving angle of 0°, and the obtained digital image data (i.e., two-dimensional brilliance distribution data) is subjected to two-dimensional Fourier transformation to obtain a power spectrum image. Subsequently, only the spatial frequency area corresponding to graininess is extracted from the power spectrum image, and the obtained measurement parameter is converted to an HG value from 0 to 100 that has a linear relation with graininess.

In the method for forming a multilayer coating film of the present invention, when the effect pigment (B) is a vapor deposition metal flake pigment, the 60 degree gloss value of the multilayer coating film is 120 or more, and preferably 130 or more; and the HG value of the multilayer coating film is 10 to 40, and preferably 10 to 35.

When the effect pigment (B) is an aluminum flake pigment, the 60 degree gloss value is 105 or more, and preferably 110 or more; and the HG value is 35 to 65, and preferably 35 to 60.

EXAMPLES

The present invention is described in more detail below with reference to Examples and Comparative Examples. However, the present invention is not limited only to these Examples. "Part(s)" and "%" are both based on mass.

Production of Acrylic Resin Aqueous Dispersion

Production Example 1

128 parts of deionized water and 2 parts of "Adeka Reasoap SR-1025" (trade name, produced by Adeka, emulsifier, active ingredient: 25%) were placed in a reaction vessel equipped with a thermometer, a thermostat, a stirrer, a reflux condenser, a nitrogen inlet tube, and a dropping funnel. The mixture was stirred and mixed in a nitrogen flow, and heated to 80° C.

Subsequently, 1% of the entire amount of monomer emulsion for the core portion, which is described below, and 5.3 parts of a 6% ammonium persulfate aqueous solution were introduced into the reaction vessel, and maintained therein at 80° C. for 15 minutes. Thereafter, the remaining monomer emulsion for the core portion was added dropwise over a period of 3 hours to the reaction vessel maintained at the same temperature. After completion of the dropwise addition, the mixture was aged for 1 hour. Subsequently, a monomer emulsion for the shell portion, which is described below, was added dropwise over a period of 1 hour, followed by aging for 1 hour. Thereafter, the mixture was cooled to 30° C. while gradually adding 40 parts of a 5% 2-(dimethylamino)ethanol aqueous solution thereto, and filtered through a 100-mesh nylon cloth, thereby obtaining an acrylic resin aqueous dispersion (R-1) having a mean particle size of 100 nm and a solids content of 30%. The obtained acrylic resin aqueous dispersion had an acid value of 33 mg KOH/g and a hydroxy value of 25 mg KOH/g.

A monomer emulsion for the core portion: 40 parts of deionized water, 2.8 parts of "Adeka Reasoap SR-1025," 2.1 parts of methylene bisacrylamide, 2.8 parts of styrene, 16.1 parts of methyl methacrylate, 28 parts of ethyl acrylate, and 21 parts of n-butyl acrylate were mixed and stirred, thereby obtaining a monomer emulsion for the core portion.

A monomer emulsion for the shell portion: 17 parts of deionized water, 1.2 parts of "Adeka Reasoap SR-1025," 0.03 parts of ammonium persulfate, 3 parts of styrene, 5.1 parts of 2-hydroxyethyl acrylate, 5.1 parts of methacrylic acid, 6 parts of methyl methacrylate, 1.8 parts of ethyl acrylate, and 9 parts of n-butyl acrylate were mixed and stirred, thereby obtaining a monomer emulsion for the shell portion.

Production of Acrylic Resin Solution

Production Example 2

35 parts of propylene glycol monopropyl ether was placed into a reaction vessel equipped with a thermometer, a thermostat, a stirrer, a reflux condenser, a nitrogen inlet tube, and a dropping funnel, and heated to 85° C. Subsequently, a mixture comprising 30 parts of methyl methacrylate, 20 parts of 2-ethylhexyl acrylate, 29 parts of n-butyl acrylate, 15 parts of 2-hydroxyethyl acrylate, 6 parts of acrylic acid, 15 parts of propylene glycol monopropyl ether, and 2.3 parts of 2,2'-azobis(2,4-dimethylvaleronitrile) was added dropwise thereto over a period of 4 hours. After completion of the dropwise addition, the mixture was aged for 1 hour. Subsequently, a mixture of 10 parts of propylene glycol monopropyl ether and 1 part of 2,2'-azobis(2,4-dimethylvaleronitrile) was further added dropwise thereto over a period of 1 hour. After completion of the dropwise addition, the mixture was aged for 1 hour. 7.4 parts of diethanolamine was further added thereto, thereby obtaining an acrylic resin solution (R-2) having a solids content of 55%. The obtained hydroxy-containing acrylic resin had an acid value of 47 mg KOH/g, a hydroxy value of 72 mg KOH/g, and a weight average molecular weight of 58000.

Production of Polyester Resin Solution

Production Example 3

109 parts of trimethylolpropane, 141 parts of 1,6-hexanediol, 126 parts of 1,2-cyclohexanedicarboxylic acid anhydride, and 120 parts of adipic acid were placed into a reaction vessel equipped with a thermometer, a thermostat, a stirrer, a reflux condenser, and a water separator. The mixture was heated to a range of 160 to 230° C. over a period of 3 hours, followed by a condensation reaction at 230° C. for 4 hours. Subsequently, to introduce a carboxy group to the obtained condensation reaction product, 38.3 parts of trimellitic anhydride was added to the product, followed by a reaction at 170° C. for 30 minutes. Thereafter, the product was diluted with 2-ethyl-1-hexanol, thereby obtaining a polyester resin solution (R-3) having a solids content of 70%. The obtained hydroxy-containing polyester resin had an acid value of 46 mg KOH/g, a hydroxy value of 150 mg KOH/g, and a number average molecular weight of 1,400.

Production of Phosphate Group-Containing Acrylic Resin

Production Example 4

A mixed solvent of 27.5 parts of methoxy propanol and 27.5 parts of isobutanol was placed in a reaction vessel equipped with a thermometer, a thermostat, a stirrer, a reflux condenser, and a dropping funnel, and heated to 110° C. While the temperature was maintained at 110° C., 121.5 parts of a mixture comprising 25 parts of styrene, 27.5 parts of n-butyl methacrylate, 20 parts of branched higher alkyl acrylate (trade name: "Isostearyl Acrylate," produced by Osaka Organic Chemical Industry Ltd.), 7.5 parts of 4-hydroxybutyl acrylate, 15 parts of a phosphate group-containing polymerizable monomer described below, 12.5 parts of 2-methacryloyloxyethyl acid phosphate, 10 parts of isobutanol, and 4 parts of tert-butylperoxy octanoate was added dropwise to the above mixed solvent over 4 hours. Further, a mixture comprising 0.5 parts of tert-butylperoxy octanoate and 20 parts of isopropanol was added dropwise for 1 hour. Then, the resultant was stirred and aged for 1 hour, thereby obtaining a phosphate group-containing acrylic resin solution (R-4) having a solids content of 50%. The phosphate group-containing acrylic resin had an acid value of 83 mgKOH/g, a hydroxy value of 29 mgKOH/g, and a weight average molecular weight of 10,000.

Phosphate group-containing polymerizable monomer: 57.5 parts of monobutyl phosphoric acid and 41 parts of isobutanol were placed in a reaction vessel equipped with a thermometer, a thermostat, a stirrer, a reflux condenser, and a dropping funnel, and heated to 90° C. After 42.5 parts of glycidyl methacrylate was added dropwise over 2 hours, the mixture was stirred and aged for 1 hour. Thereafter, 59 parts of isopropanol was added, thereby obtaining a phosphate group-containing polymerizable monomer solution having a solids content of 50%. The acid value of the obtained monomer was 285 mgKOH/g.

Production of Extender Pigment Dispersion

Production Example 5

327 parts (solids content: 180 parts) of the acrylic resin solution (R-2), 360 parts of deionized water, 6 parts of Surfynol 104A (trade name, produced by Air Products, antifoaming agent, solids content: 50%), and 250 parts of Barifine BF-20 (trade name, produced by Sakai Chemical Industry Co., Ltd., barium sulfate powder, average particle size: 0.03 μm) were placed in a paint conditioner, and a glass bead medium was added thereto. The mixture was mixed and dispersed at room temperature for 1 hour, thereby obtaining an extender pigment dispersion (P-1) having a solids content of 44%.

Production of Color Pigment Dispersion

Production Example 6

327 parts (solids content: 180 parts) of the acrylic resin solution (R-2), 500 parts of "Titanix JR-806" (trade name, produced by Tayca Corporation, titanium oxide), 5 parts of "MA-100" (trade name, produced by Mitsubishi Chemical Corporation, carbon black), and 500 parts of deionized water were mixed. After the pH of the mixture was adjusted to 8.2 using 2-(dimethylamino)ethanol, the mixture was dispersed in a paint shaker for 30 minutes, thereby obtaining a color pigment dispersion (P-2) having a solids content of 51%.

Production of Base Paint (X)

Production of Transparent Base Paint (X-1)

Production Example 7

In a stirring vessel, 14 parts (on a solids basis) of the extender pigment dispersion (P-1), 40 parts (on a solids basis) of the acrylic resin aqueous dispersion (R-1), 23 parts (on a solids basis) of the polyester resin solution (R-3), 10 parts (on a solids basis) of "U-COAT UX-310" (trade name, produced by Sanyo Chemical Industries, Ltd., urethane resin aqueous dispersion, solids content: 40%), and 27 parts (on a solids basis) of "Cymel 251" (trade name, produced by Nihon Cytec Industries Inc., melamine resin, solids content: 80%) were stirred and mixed, thereby preparing a transparent base paint (X-1).

Production of Colored Base Paint (X-2)

Production Example 8

In a stirring vessel, 23 parts (on a solids basis) of the color pigment dispersion (P-2), 40 parts (on a solids basis) of the acrylic resin aqueous dispersion (R-1), 23 parts (on a solids basis) of the polyester resin solution (R-3), 10 parts (on a solids basis) of "U-COAT UX-310" (trade name, produced by Sanyo Chemical Industries, Ltd., urethane resin aqueous dispersion, solids content: 40%), and 27 parts (on a solids basis) of "Cymel 251" (trade name, produced by Nihon Cytec Industries Inc., melamine resin, solids content: 80%) were stirred and mixed, thereby preparing a colored base paint (X-2).

Surface Adjusting Agent (A)

Table 1 shows the properties of surface adjusting agents (A) used in the production of an effect pigment dispersion (Y) described later.

(A-1) to (A-4) are all commercially available surface adjusting agents. (A-1) is a silicone-based surface adjusting agent, (A-2) is a mixture of a surface adjusting agent of an amphiphilic oligomer and a silicone-based surface adjusting agent, (A-3) is polyether-based siloxane, and (A-4) is a fluorine-modified acrylic surface adjusting agent.

TABLE 1

| Name | (A-1) | (A-2) | (A-3) | (A-4) |
|---|---|---|---|---|
| Contact angle [°] (Note 1) | 13 | 12 | 14 | 39 |
| Dynamic surface tension [mN/m] | 63.9 | 51.5 | 68.7 | 71.3 |
| Static surface tension [mN/m] | 22.2 | 21.6 | 21.9 | 38.8 |
| Lamellar length [mm] | 7.45 | 7.40 | 7.46 | 7.55 |

Note 1:

A contact angle with respect to a previously degreased tin plate (produced by Paltek Corporation) measured in such a manner that a liquid prepared by mixing isopropanol, water, and the surface adjusting agent (A) at a mass ratio of 4.5/95/1 was adjusted to have a viscosity of 100 mPa · s measured by a Brookfield type viscometer at a rotor rotational speed of 60 rpm at a temperature of 20° C., 10 μL of the liquid was added dropwise to the tin plate, and the contact angle with respect to the tin plate was measured by a contact angle meter (CA-X150, trade name, produced by Kyowa Interface Science Co., Ltd.) 10 seconds after the dropwise addition.

Note 1: A contact angle with respect to a previously degreased tin plate (produced by Paltek Corporation) measured in such a manner that a liquid prepared by mixing isopropanol, water, and the surface adjusting agent (A) at a mass ratio of 4.5/95/1 was adjusted to have a viscosity of 100 mPa·s measured by a Brookfield type viscometer at a rotor rotational speed of 60 rpm at a temperature of 20° C., 10 μL of the liquid was added dropwise to the tin plate, and the contact angle with respect to the tin plate was measured by a contact angle meter (CA-X150, trade name, produced by Kyowa Interface Science Co., Ltd.) 10 seconds after the dropwise addition.

Production of Effect Pigment Dispersion (Y)

Production Example 9

In a stirring vessel, 3 parts of distilled water, 0.02 parts (on a solids basis) of the surface adjusting agent (A-3), 1.4 parts (on a solids basis) of Hydroshine WS-3004 (an aqueous vapor deposition aluminum flake pigment, produced by Eckart, solids content: 10%; internal solvent: isopropanol, average particle size D50: 13 μm, thickness: 0.05 μm; the surface was treated with silica), 0.4 parts (on a solids basis) of "Rheocrysta" (trade name, produced by DKS Co. Ltd., Cellulose Nano Fiber, solids content: 2%), 0.1 parts of dimethylethanolamine, and 0.5 parts (on a solids basis) of the phosphate group-containing acrylic resin solution (R-4) were stirred and mixed, thereby preparing an effect pigment dispersion (Y-1).

Production Examples 10 to 43

Effect pigment dispersions (Y-2) to (Y-17) were obtained in the same manner as in Production Example 9, except that the formulations shown in Table 2 were used. In a system in which vapor deposition aluminum flake was used as the effect pigment (B) of Table 2, producing an effect pigment dispersion (Y) with a solids content exceeding 10 mass % was difficult since the vapor deposition aluminum flake itself has a solids content of 10 mass %.

Further, effect pigment dispersions (Y-18) to (Y-35) were obtained in the same manner as in Production Example 9, except that the formulations shown in Table 3 were used.

The following are components shown in Tables 2 and 3.

"EMR B6360" (trade name), produced by Toyo Aluminium K.K., silica-treated aluminum flake "Acrysol ASE-60" (trade name) produced by Dow Chemical Co., Ltd., a polyacrylic acid-based rheology control agent, solids content: 28%

"Cymel 327" (trade name), a water-soluble melamine resin, solids content: 90%

"HR-517" trade name: Diyanal HR517," produced by Mitsubishi Rayon Co., Ltd., acrylic resin containing N-butoxymethylacrylamide as a polymerizable component, solids content: 50%

"Cyanine Blue 5206" (trade name), produced by Dainichiseika Color & Chemicals Mfg. Co., Ltd., an organic blue pigment

TABLE 2

(Numerical values in parentheses in the table are solids contents.)

| Production Sample No. | | | 9 | 10 | 11 | 12 | 13 |
|---|---|---|---|---|---|---|---|
| Name of effect pigment dispersion | | | Y-1 | Y-2 | Y-3 | Y-4 | Y-5 |
| Formulation | Water | Distilled water | 64 | 64 | 64 | 64 | 64 |
| | Surface adjusting agent (A) | A-1 | | | | 1.0 (1.0) | |
| | | A-2 | | | | | 1.0 (1.0) |
| | | A-3 | 0.02 (0.02) | 1.1 (1.0) | 1.8 (1.5) | | |
| | | A-4 | | | | | |
| | Effect pigment (B) | Vapor deposition aluminum flake "WS3004" | 14 (1.4) | 14 (1.4) | 14 (1.4) | 14 (1.4) | 14 (1.4) |
| | Rheology control agent (C) | "Rheocrysta" | 20 (0.4) | 20 (0.4) | 20 (0.4) | 20 (0.4) | 20 (0.4) |
| | | "ASE-60" | | | | | |
| | | Dimethylethanolamine | 0.1 | 0.1 | 0.1 | 0.1 | 0.1 |
| | Resin | Phosphate group-containing acrylic resin (R-4) | 1 (0.5) | 1 (0.5) | 1 (0.5) | 1 (0.5) | 1 (0.5) |
| | | Water-soluble melamine resin "Cymel 327" | | | | | |
| | | Acrylic resin aqueous dispersion (R-1) | | | | | |
| Performance | Solids content of effect pigment dispersion (Y) (%) | | 2.3 | 3.3 | 3.8 | 3.3 | 3.3 |
| | Paint viscosity B60 value/mPa · s | | 500 | 500 | 500 | 500 | 500 |
| | Amount of effect pigment (B) (parts by mass) per 100 parts by mass of effect pigment dispersion (Y) | | 1.4 | 1.4 | 1.4 | 1.4 | 1.4 |

| Production Sample No. | | | 14 | 15 | 16 | 17 | 18 |
|---|---|---|---|---|---|---|---|
| Name of effect pigment dispersion | | | Y-6 | Y-7 | Y-8 | Y-9 | Y-10 |
| Formulation | Water | Distilled water | 64 | 78 | 71 | 82 | 71 |
| | Surface adjusting agent (A) | A-1 | | | | | |
| | | A-2 | | | | | |
| | | A-3 | | 1.1 (1.0) | 1.1 (1.0) | 1.1 (1.0) | 1.4 (1.2) |
| | | A-4 | 1.6 (1.0) | | | | |
| | Effect pigment (B) | Vapor deposition aluminum flake "WS3004" | 14 (1.4) | 14 (1.4) | 14 (1.4) | 14 (1.4) | 2 (0.2) |
| | Rheology control agent (C) | "Rheocrysta" | 20 (0.4) | 5 (0.1) | 25 (0.5) | | 25 (0.5) |
| | | "ASE-60" | | | | 1.7 (0.5) | |
| | | Dimethylethanolamine | 0.1 | 0.1 | 0.1 | 0.2 | 0.1 |

TABLE 2-continued (Numerical values in parentheses in the table are solids contents.)

| | | | | | | | |
|---|---|---|---|---|---|---|---|
| | Resin | Phosphate group-containing acrylic resin (R-4) | 1 (0.5) | 1 (0.5) | 1 (0.5) | 1 (0.5) | 1 (0.5) |
| | | Water-soluble melamine resin "Cymel 327" | | | | | |
| | | Acrylic resin aqueous dispersion (R-1) | | | | | |
| Performance | Solids content of effect pigment dispersion (Y) (%) | | 3.3 | 3.0 | 3.0 | 3.4 | 2.4 |
| | Paint viscosity B60 value/mPa · s | | 500 | 55 | 1600 | 500 | 500 |
| | Amount of effect pigment (B) (parts by mass) per 100 parts by mass of effect pigment dispersion (Y) | | 1.4 | 1.4 | 1.2 | 1.4 | 0.2 |

| | | | | | | |
|---|---|---|---|---|---|---|
| | Production Example No. | | 19 | 20 | 21 | 22 |
| | Name of effect pigment dispersion | | Y-11 | Y-12 | Y-13 | Y-14 |
| Formulation | Water | Distilled water | 64 | 64 | 64 | 315 |
| | Surface adjusting agent (A) | A-1 | | | | |
| | | A-2 | | | | |
| | | A-3 | 1.1 (1.0) | 0.6 (0.5) | 0.6 (0.5) | 0.6 (0.5) |
| | | A-4 | | | | |
| | Effect pigment (B) | Vapor deposition aluminum flake "WS3004" | 30 (3.0) | 14 (1.4) | 14 (1.4) | 14 (1.4) |
| | Rheology control agent (C) | "Rheocrysta" | 20 (0.4) | 20 (0.4) | 20 (0.4) | 20 (0.4) |
| | | "ASE-60" | | | | |
| | | Dimethylethanolamine | 0.1 | 0.1 | 0.1 | 0.1 |
| | Resin | Phosphate group-containing acrylic resin (R-4) | 1 (0.5) | 1 (0.5) | 1 (0.5) | 1 (0.5) |
| | | Water-soluble melamine resin "Cymel 327" | | 0.6 (0.5) | | |
| | | "HR-517" | | | | |
| | | Acrylic resin aqueous dispersion (R-1) | | | 1.7 (0.5) | |
| | Pigment | "Cyanine Blue 5206" | | | | |
| Performance | Solids content of effect pigment dispersion (Y) (%) | | 4.2 | 3.3 | 3.3 | 0.8 |
| | Paint viscosity B60 value/mPa · s | | 400 | 500 | 500 | 60 |
| | Amount of effect pigment (B) (parts by mass) per 100 parts by mass of effect pigment dispersion (Y) | | 2.6 | 1.4 | 1.4 | 0.4 |

| | | | | | |
|---|---|---|---|---|---|
| | Production Example No. | | 23 | 24 | 25 |
| | Name of effect pigment dispersion | | Y-15 | Y-16 | Y-17 |
| Formulation | Water | Distilled water | 64 | 64 | 1385 |
| | Surface adjusting agent (A) | A-1 | | | |
| | | A-2 | | | |
| | | A-3 | 1.1 (1.0) | 1.1 (1.1) | 0.6 (0.5) |
| | | A-4 | | | |
| | Effect pigment (B) | Vapor deposition aluminum flake "WS3004" | 14 (1.4) | 14 (1.4) | 14 (1.4) |
| | Rheology control agent (C) | "Rheocrysta" | 20 (0.4) | 20 (0.4) | 20 (0.4) |
| | | "ASE-60" | | | |
| | | Dimethylethanolamine | 0.1 | 0.1 | 0.1 |
| | Resin | Phosphate group-containing acrylic resin (R-4) | 1 (0.5) | 1 (0.5) | 1 (0.5) |
| | | Water-soluble melamine resin "Cymel 327" | | | |
| | | "HR-517" | 2.8 (1.4) | | |
| | | Acrylic resin aqueous dispersion (R-1) | | | |
| | Pigment | "Cyanine Blue 5206" | | 14 (1.4) | |
| Performance | Solids content of effect pigment dispersion (Y) (%) | | 3.3 | 3.3 | 0.2 |
| | Paint viscosity B60 value/mPa · s | | 500 | 500 | 10 |
| | Amount of effect pigment (B) (parts by mass) per 100 parts by mass of effect pigment dispersion (Y) | | 1.4 | 1.4 | 0.1 |

TABLE 3

(Numerical values in parentheses in the table are solids contents.)

| Production Example No. | | | 26 | 27 | 28 | 29 | 30 |
|---|---|---|---|---|---|---|---|
| Name of effect pigment dispersion | | | Y-18 | Y-19 | Y-20 | Y-21 | Y-22 |
| Formulation | Water | Distilled water | 80 | 80 | 80 | 80 | 80 |
| | Surface adjusting agent (A) | A-1 | | | | 1.0 (1.0) | |
| | | A-2 | | | | | 1.0 (1.0) |
| | | A-3 | 0.02 (0.02) | 1.1 (1.0) | 1.8 (1.5) | | |
| | | A-4 | | | | | |
| | Effect pigment (B) | Aluminum flake "EMR B6360" | 5.4 (2.5) | 5.4 (2.5) | 5.4 (2.5) | 5.4 (2.5) | 5.4 (2.5) |
| | Rheology control agent (C) | "Rheocrysta" "ASE-60" | 20 (0.4) | 20 (0.4) | 20 (0.4) | 20 (0.4) | 20 (0.4) |
| | | Dimethylethanolamine | 0.2 | 0.2 | 0.2 | 0.2 | 0.2 |
| | Resin | Phosphate group-containing acrylic resin (R-4) | 2 (1) | 2 (1) | 2 (1) | 2 (1) | 2 (1) |
| | | Water-soluble melamine resin "Cymel 327" "HR-517" | | | | | |
| | | Acrylic resin aqueous dispersion (R-1) | | | | | |
| | Pigment | "Cyanine Blue 5206" | | | | | |
| Performance | Solids content of effect pigment dispersion (Y) (%) | | 3.3 | 4.1 | 4.5 | 4.1 | 4.1 |
| | Paint viscosity B60 value/mPa · s | | 300 | 300 | 300 | 300 | 300 |
| | Amount of effect pigment (B) (parts by mass) per 100 parts by mass of effect pigment dispersion (Y) | | 2.1 | 2.1 | 2.1 | 2.1 | 2.1 |

| Production Example No. | | | 31 | 32 | 33 | 34 | 35 |
|---|---|---|---|---|---|---|---|
| Name of effect pigment dispersion | | | Y-23 | Y-24 | Y-25 | Y-26 | Y-27 |
| Formulation | Water | Distilled water | 80 | 94 | 75 | 98 | 80 |
| | Surface adjusting agent (A) | A-1 | | | | | |
| | | A-2 | | | | | |
| | | A-3 | | 1.1 (1.0) | 1.1 (1.0) | 1.1 (1.0) | 1.1 (1.0) |
| | | A-4 | 1.6 (1.0) | | | | |
| | Effect pigment (B) | Aluminum flake "EMR B6360" | 5.4 (2.5) | 5.4 (2.5) | 5.4 (2.5) | 5.4 (2.5) | 2.1 (1) |
| | Rheology control agent (C) | "Rheocrysta" | 20 (0.4) | 5 (0.1) | 25 (0.5) | | 20 (0.4) |
| | | "ASE-60" | | | | 1.7 (0.5) | |
| | | Dimethylethanolamine | 0.2 | 0.2 | 0.2 | 0.3 | 0.2 |
| | Resin | Phosphate group-containing acrylic resin (R-4) | 2 (1) | 2 (1) | 2 (1) | 2 (1) | 2 (1) |
| | | Water-soluble melamine resin "Cymel 327" "HR-517" | | | | | |
| | | Acrylic resin aqueous dispersion (R-1) | | | | | |
| | Pigment | "Cyanine Blue 5206" | | | | | |
| Performance | Solids content of effect pigment dispersion (Y) (%) | | 4.1 | 4.3 | 4.6 | 4.6 | 3.2 |
| | Paint viscosity B60 value/mPa · s | | 300 | 50 | 1600 | 400 | 300 |
| | Amount of effect pigment (B) (parts by mass) per 100 parts by mass of effect pigment dispersion (Y) | | 2.1 | 2.3 | 2.3 | 2.3 | 0.9 |

| Production Example No. | | | 36 | 37 | 38 | 39 |
|---|---|---|---|---|---|---|
| Name of effect pigment dispersion | | | Y-28 | Y-29 | Y-30 | Y-31 |
| Formulation | Water | Distilled water | 80 | 80 | 80 | 460 |
| | Surface adjusting agent (A) | A-1 | | | | |
| | | A-2 | | | | |
| | | A-3 | 1.1 (1.0) | 1.1 (1.0) | 1.1 (1.0) | 0.6 (0.5) |
| | | A-4 | | | | |
| | Effect pigment (B) | Aluminum flake "EMR B6360" | 10.6 (5) | 5.4 (2.5) | 5.4 (2.5) | 5.4 (2.5) |
| | Rheology control agent (C) | "Rheocrysta" "ASE-60" | 20 (0.4) | 20 (0.4) | 20 (0.4) | 20 (0.4) |
| | | Dimethylethanolamine | 0.4 | 0.2 | 0.2 | 0.2 |
| | Resin | Phosphate group-containing acrylic resin (R-4) | 4 (2) | 2 (1) | 2 (1) | 1 (0.5) |
| | | Water-soluble melamine resin "Cymel 327" | | 0.5 (0.5) | | |

TABLE 3-continued (Numerical values in parentheses in the table are solids contents.)

| | | | | | | |
|---|---|---|---|---|---|---|
| | | "HR-517" | | | | |
| | | Acrylic resin aqueous dispersion (R-1) | | | 2 (0.5) | |
| | Pigment | "Cyanine Blue 5206" | | | | |
| Performance | Solids content of effect pigment dispersion (Y) (%) | | 7.2 | 4.9 | 4.9 | 0.8 |
| | Paint viscosity B60 value/mPa · s | | 600 | 300 | 300 | 60 |
| | Amount of effect pigment (B) (parts by mass) per 100 parts by mass of effect pigment dispersion (Y) | | 4.3 | 2.3 | 2.3 | 0.5 |

| | | | | | | |
|---|---|---|---|---|---|---|
| | Production Example No. | | 40 | 41 | 42 | 43 |
| | Name of effect pigment dispersion | | Y-32 | Y-33 | Y-34 | Y-35 |
| Formulation | Water | Distilled water | 80 | 80 | 80 | 1925 |
| | Surface adjusting agent (A) | A-1 | | | | |
| | | A-2 | | | | |
| | | A-3 | 1.1 (1.0) | 1.1 (1.0) | 1.1 (1.0) | 0.6 (0.5) |
| | | A-4 | | | | |
| | Effect pigment (B) | Aluminum flake "EMR B6360" | 5.4 (2.5) | 5.4 (2.5) | 21.3 (10) | 5.4 (2.5) |
| | Rheology control agent (C) | "Rheocrysta" | 20 (0.4) | 20 (0.4) | 20 (0.4) | 20 (0.4) |
| | | "ASE-60" | | | | |
| | | Dimethylethanolamine | 0.2 | 0.2 | 0.4 | 0.2 |
| | Resin | Phosphate group-containing acrylic resin (R-4) | 2 (1) | 2 (1) | 4 (2) | 1 (0.5) |
| | | Water-soluble melamine resin "Cymel 327" | | | | |
| | | "HR-517" | 5.0 (2.5) | | | |
| | | Acrylic resin aqueous dispersion (R-1) | | | | |
| | Pigment | "Cyanine Blue 5206" | | 1.0 (1.0) | | |
| Performance | Solids content of effect pigment dispersion (Y) (%) | | 4.1 | 4.1 | 10.6 | 0.2 |
| | Paint viscosity B60 value/mPa · s | | 300 | 300 | 500 | 10 |
| | Amount of effect pigment (B) (parts by mass) per 100 parts by mass of effect pigment dispersion (Y) | | 2.1 | 2.1 | 7.9 | 0.1 |

Preparation of Colored Paint (W)

"TP-65 Dark Gray" (trade name, produced by Kansai Paint Co., Ltd., polyester resin-based intermediate paint, L* value of the coating film to be obtained: 20) was used as a colored paint (W-1).

Preparation of Clear Paint (Z)

Clear Paint (Z-1)

"KIN06510" (trade name, produced by Kansai Paint Co., Ltd., hydroxy/isocyanate curable acrylic resin and urethane resin-based two-component organic solvent-based paint) was used as a clear paint (Z-1).

Clear Paint (Z-2)

"KINO1200" (trade name: Kansai Paint Co., Ltd., acid/epoxy curable acrylic resin-based one-component organic solvent-based paint) was used as a clear paint (Z-2).

Clear Paint (Z-3)

"Magicron TC-71" (trade name: Kansai Paint Co., Ltd., acryl and melamine resin-based one-component organic solvent-based paint) was used as a clear paint (Z-3).

Preparation of Substrate

A cationic electrodeposition paint "Elecron 9400HB" (trade name, produced by Kansai Paint Co., Ltd., an amine-modified epoxy resin-based cationic resin containing a blocked polyisocyanate compound as a curing agent) was applied by electrodeposition to a degreased and zinc phosphate-treated steel plate (JISG3141, size: 400×300×0.8 nm) to a film thickness of 20 μm when cured. The resulting film was heated at 170° C. for 20 minutes to be cured by crosslinking, thereby obtaining a substrate 1.

Production of Test Plate

Example 1

Step (1): The colored paint (W-1) was applied to the substrate 1 to a cured film thickness of 30 to 40 μm by electrostatic spraying using a rotary atomization-type bell-shaped coating device, and the resulting film was heated at 140° C. for 30 minutes to be cured by crosslinking.

Step (2): Subsequently, the transparent base paint (X-1) was applied to the cured coating film to a cured film thickness of 10 to 12 μm by electrostatic spraying using a rotary atomization-type bell-shaped coating device, and the resulting film was allowed to stand for 2 minutes.

Step (3): Subsequently, the effect pigment dispersion (Y-1) was adjusted to have a paint viscosity shown in Table 2 and applied to the coating film using a robot bell (produced by ABB) under the conditions in which the booth temperature was 23° C. and the humidity was 68%, so that the dry film thickness of the effect pigment dispersion (Y-1) was 0.5 μm after step (5). The resultant was then allowed to stand at 80° C. for 3 minutes.

Step (4): Subsequently, the clear paint (Z-1) was applied to the dry coating film surface using a robot bell (produced by ABB) under the conditions in which the booth temperature was 23° C. and the humidity was 68%, so that the dry film thickness of the clear paint (Z-1) was 25 to 35 μm after step (5).

Step (5): After coating, the resultant was allowed to stand at room temperature for 7 minutes, and then heated in a hot air circulation-type dryer at 140° C. for 30 minutes to simultaneously dry the multilayer coating films, thereby obtaining a test plate.

The dry film thickness of the effect coating film shown in Table 4 was calculated from the following formula (2). The same applies to the following Examples.

$$x=(sc*10000)/(S*sg) \quad (2)$$

x: film thickness [μm]
sc: coating solids content [g]
S: evaluation area of coating solids content [$cm^2$]sg: coating film specific gravity [$g/cm^3$]

Examples 2 to 21 and Comparative Examples 1 to 2

Test plates were obtained in the same manner as in Example 1, except that the base paint (X), dispersion (Y), clear paint (Z), and dry film thickness of the effect coating film shown in Table 4 were used.

Example 23

Step (1): The colored paint (W-1) was applied to the substrate 1 to a cured film thickness of 30 to 40 μm by electrostatic spraying using a rotary atomization-type bell-shaped coating device, and the resulting film was heated at 140° C. for 30 minutes to be cured by crosslinking. Subsequently, the coating film was polished with sandpaper #2000, and the surface was wiped off with gasoline.

Step (2): Subsequently, the transparent base paint (X-1) was applied to the cured coating film to a cured film thickness of 10 to 12 μm by electrostatic spraying using a rotary atomization-type bell-shaped coating device, and the resulting film was allowed to stand for 2 minutes.

Step (3): Subsequently, the effect pigment dispersion (Y-2) was adjusted to have a paint viscosity shown in Table 2 and applied to the coating film using a robot bell (produced by ABB) under the conditions in which the booth temperature was 23° C. and the humidity was 68%, so that the dry film thickness of the effect pigment dispersion (Y-2) was 0.5 μm after step (5). The resultant was then allowed to stand at 80° C. for 3 minutes.

Step (4): Subsequently, the clear paint (Z-1) was applied to the dry coating film surface using a robot bell (produced by ABB) under the conditions in which the booth temperature was 23° C. and the humidity was 68%, so that the dry film thickness of the clear paint (Z-1) was 25 to 35 μm after step (5).

Step (5): After coating, the resultant was allowed to stand at room temperature for 7 minutes, and then heated in a hot air circulation-type dryer at 140° C. for 30 minutes to simultaneously dry the multilayer coating films, thereby obtaining a test plate.

Comparative Example 3

Step (1): The colored paint (W-1) was applied to the substrate 1 to a cured film thickness of 30 to 40 μm by electrostatic spraying using a rotary atomization-type bell-shaped coating device, and the resulting film was allowed to stand at room temperature for 15 minutes.

Step (2): Subsequently, the transparent base paint (X-1) was applied to the cured coating film to a cured film thickness of 10 to 12 μm by electrostatic spraying using a rotary atomization-type bell-shaped coating device, and the resulting film was allowed to stand for 2 minutes.

Step (3): Subsequently, the effect pigment dispersion (Y-2) was adjusted to have a paint viscosity shown in Table 2 and applied to the coating film using a robot bell (produced by ABB) under the conditions in which the booth temperature was 23° C. and the humidity was 68%, so that the dry film thickness of the effect pigment dispersion (Y-2) was 0.5 μm after step (5). The resultant was then allowed to stand at 80° C. for 3 minutes.

Step (4): Subsequently, the clear paint (Z-1) was applied to the dry coating film surface using a robot bell (produced by ABB) under the conditions in which the booth temperature was 23° C. and the humidity was 68%, so that the dry film thickness of the clear paint (Z-1) was 25 to 35 μm after step (5).

Step (5): After coating, the resultant was allowed to stand at room temperature for 7 minutes, and then heated in a hot air circulation-type dryer at 140° C. for 30 minutes to simultaneously dry the multilayer coating films, thereby obtaining a test plate.

Example 24

Step (1): The colored paint (W-1) was applied to the substrate 1 to a cured film thickness of 30 to 40 μm by electrostatic spraying using a rotary atomization-type bell-shaped coating device, and the resulting film was heated at 140° C. for 30 minutes to be cured by crosslinking.

Step (2): Subsequently, the transparent base paint (X-1) was applied to the cured coating film to a cured film thickness of 10 to 12 μm by electrostatic spraying using a rotary atomization-type bell-shaped coating device, and the resulting film was allowed to stand for 2 minutes.

Step (3): Subsequently, the effect pigment dispersion (Y-18) was adjusted to have a paint viscosity shown in Table 3 and applied to the coating film using a robot bell (produced by ABB) under the conditions in which the booth temperature was 23° C. and the humidity was 68%, so that the dry film thickness of the effect pigment dispersion (Y-18) was 0.5 μm after step (5).

The resultant was then allowed to stand at 80° C. for 3 minutes.

Step (4): Subsequently, the clear paint (Z-1) was applied to the dry coating film surface using a robot bell (produced by ABB) under the conditions in which the booth temperature was 23° C. and the humidity was 68%, so that the dry film thickness of the clear paint (Z-1) was 25 to 35 μm after step (5).

Step (5): After coating, the resultant was allowed to stand at room temperature for 7 minutes, and then heated in a hot air circulation-type dryer at 140° C. for 30 minutes to simultaneously dry the multilayer coating films, thereby obtaining a test plate.

The dry film thickness of the effect coating film shown in Table 5 was calculated from the formula (2) above. The same applies to the following Examples.

Examples 25 to 44 and Comparative Examples 4 to 6

Test plates were obtained in the same manner as in Example 24, except that the base paint (X), dispersion (Y), clear paint (Z), and dry film thickness of the effect coating film shown in Table 5 were used.

Example 46

Step (1): The colored paint (W-1) was applied to the substrate 1 to a cured film thickness of 30 to 40 μm by electrostatic spraying using a rotary atomization-type bell-shaped coating device, and the resulting film was heated at 140° C. for 30 minutes to be cured by crosslinking. Subsequently, the coating film was polished with sandpaper #2000, and the surface was wiped off with gasoline.

Step (2): Subsequently, the transparent base paint (X-1) was applied to the cured coating film to a cured film thickness of 10 to 12 μm by electrostatic spraying using a rotary atomization-type bell-shaped coating device, and the resulting film was allowed to stand for 2 minutes.

Step (3): Subsequently, the effect pigment dispersion (Y-19) was adjusted to have a paint viscosity shown in Table 3 and applied to the coating film using a robot bell (produced by ABB) under the conditions in which the booth temperature was 23° C. and the humidity was 68%, so that the dry film thickness of the effect pigment dispersion (Y-19) was 0.9 μm after step (5). The resultant was then allowed to stand at 80° C. for 3 minutes.

Step (4): Subsequently, the clear paint (Z-1) was applied to the dry coating film surface using a robot bell (produced by ABB) under the conditions in which the booth temperature was 23° C. and the humidity was 68%, so that the dry film thickness of the clear paint (Z-1) was 25 to 35 μm after step (5).

Step (5): After coating, the resultant was allowed to stand at room temperature for 7 minutes, and then heated in a hot air circulation-type dryer at 140° C. for 30 minutes to simultaneously dry the multilayer coating films, thereby obtaining a test plate.

Comparative Example 7

Step (1): The colored paint (W-1) was applied to the substrate 1 to a cured film thickness of 30 to 40 μm by electrostatic spraying using a rotary atomization-type bell-shaped coating device, and the resulting film was allowed to stand at room temperature for 15 minutes, Step (2): Subsequently, the transparent base paint (X-1) was applied to the cured coating film to a cured film thickness of 10 to 12 μm by electrostatic spraying using a rotary atomization-type bell-shaped coating device, and the resulting film was allowed to stand for 2 minutes.

Step (3): Subsequently, the effect pigment dispersion (Y-19) was adjusted to have a paint viscosity shown in Table 3 and applied to the coating film using a robot bell (produced by ABB) under the conditions in which the booth temperature was 23° C. and the humidity was 68%, so that the dry film thickness of the effect pigment dispersion (Y-19) was 0.9 μm after step (5).

The resultant was then allowed to stand at 80° C. for 3 minutes.

Step (4): Subsequently, the clear paint (Z-1) was applied to the dry coating film surface using a robot bell (produced by ABB) under the conditions in which the booth temperature was 23° C. and the humidity was 68%, so that the dry film thickness of the clear paint (Z-1) was 25 to 35 μm after step (5).

Step (5): After coating, the resultant was allowed to stand at room temperature for 7 minutes, and then heated in a hot air circulation-type dryer at 140° C. for 30 minutes to simultaneously dry the multilayer coating films, thereby obtaining a test plate.

Evaluation of Coating Film

Evaluation of Coating Films of Examples 1 to 21 and 23 and Comparative Examples 1 to 3

The appearance and performance of the coating film of each test plate obtained in the above manner were evaluated. Table 4 shows the results.

Evaluation of Appearance

The coating film appearance was evaluated by graininess, anti-water adhesion, specular gloss (60 degree), and undercoat hiding power.

Graininess

The graininess was evaluated as a hi-light graininess value (hereinafter abbreviated as the "HG value"). The HG value is a parameter of microscopic brilliance obtained by the microscopic observation of a coating surface, and indicates the graininess in the highlight. The HG value is calculated as follows. First, the coating surface is photographed with a CCD camera at a light incidence angle of 15° and a receiving angle of 0°, and the obtained digital image data (two-dimensional brilliance distribution data) is subjected to two-dimensional Fourier transformation to obtain a power spectrum image. Subsequently, only the spatial frequency area corresponding to graininess is extracted from the power spectrum image, and the obtained measurement parameter is converted to a numerical value from 0 to 100 that has a linear relation with graininess, thus obtaining an HG value. An HG value of 0 indicates no graininess of the effect pigment at all, and an HG value of 100 indicates the highest possible graininess of the effect pigment.

The graininess HG is preferably 10 to 40, in terms of the denseness of the metallic coating film.

Anti-Water Adhesion

Each test plate was immersed in warm water at 80° C. for 5 hours. Immediately after the test plate was removed from the water, cross-cuts reaching the substrate were made in the multilayer coating film of the test plate using a cutter knife to form a grid of 100 squares (2 mm×2 mm). Subsequently, adhesive cellophane tape was applied to the surface of the grid portion, and the tape was peeled off rapidly at 20° C. Then, the condition of squares remaining was checked, and anti-water adhesion was evaluated according to the following criteria.

Pass: 100 squares of the coating film remained, and no small edge peeling of the coating film occurred at the edge of the cut made by the cutter knife.

Fail: The remaining number of squares of the coating film was 99 or less.

Specular Gloss (60 Degree)

The 60 degree gloss value of the test plates obtained above was measured using a gloss meter (micro-TRI-gloss, produced by BYK-Gardner). A numerical value of 120 or more is regarded as acceptance.

Undercoat Hiding Power

In Examples 1 to 21 and Comparative Examples 1 to 2, a colored coating film was formed using the colored paint (W-1) in step (1), and the coating film surface was polished with sandpaper #2000 and wiped off with gasoline, followed by obtaining a multilayer coating film by performing step (2) and the subsequent steps. The obtained multilayer coating film was visually observed to evaluate undercoat hiding power according to the following criteria. The test plate of Example 23 was directly subjected to the test for undercoat hiding power.

Pass: No gouge marks were observed.

Fail: Gouge marks were observed.

The multilayer coating film of the test plate of Comparative Example 2 showed no undercoat hiding power, and was inappropriate as the multilayer coating film of the present invention.

TABLE 4

| | | Examples | | | | | | | | | |
|---|---|---|---|---|---|---|---|---|---|---|---|
| | | 1 | 2 | 3 | 4 | 5 | 6 | 7 | 8 | 9 | 10 |
| Name of substrate | | 1 | 1 | 1 | 1 | 1 | 1 | 1 | 1 | 1 | 1 |
| Name of colored paint (W) | | W-1 | W-1 | W-1 | W-1 | W-1 | W-1 | W-1 | W-1 | W-1 | W-1 |
| Heating after application of colored paint (W) | | Yes | Yes | Yes | Yes | Yes | Yes | Yes | Yes | Yes | Yes |
| Polishing | | No | No | No | No | No | No | No | No | No | No |
| Name of base paint (X) | | X-1 | X-1 | X-1 | X-1 | X-1 | X-1 | X-1 | X-1 | X-1 | X-1 |
| Name of effect pigment dispersion (Y) | | Y-1 | Y-2 | Y-3 | Y-4 | Y-5 | Y-6 | Y-7 | Y-8 | Y-9 | Y-10 |
| Name of clear paint (Z) | | Z-1 | Z-1 | Z-1 | Z-1 | Z-1 | Z-1 | Z-1 | Z-1 | Z-1 | Z-1 |
| Dry film thickness (μm) of effect coating film | | 0.5 | 0.5 | 0.5 | 0.5 | 0.5 | 0.5 | 0.5 | 0.5 | 0.5 | 0.5 |
| Coating film performance | Graininess (HG value) | 32 | 33 | 35 | 33 | 34 | 38 | 40 | 30 | 38 | 40 |
| | Anti-water adhesion | Pass | Pass | Pass | Pass | Pass | Pass | Pass | Pass | Pass | Pass |
| | 60 degree gloss | 146 | 145 | 143 | 145 | 145 | 138 | 135 | 150 | 135 | 132 |
| | Undercoat hiding power | Pass | Pass | Pass | Pass | Pass | Pass | Pass | Pass | Pass | Pass |

| | | Examples | | | | | | | | | |
|---|---|---|---|---|---|---|---|---|---|---|---|
| | | 11 | 12 | 13 | 14 | 15 | 16 | 17 | 18 | 19 | 20 |
| Name of substrate | | 1 | 1 | 1 | 1 | 1 | 1 | 1 | 1 | 1 | 1 |
| Name of colored paint (W) | | W-1 | W-1 | W-1 | W-1 | W-1 | W-1 | W-1 | W-1 | W-1 | W-1 |
| Heating after application of colored paint (W) | | Yes | Yes | Yes | Yes | Yes | Yes | Yes | Yes | Yes | Yes |
| Polishing | | No | No | No | No | No | No | No | No | No | No |
| Name of base paint (X) | | X-1 | X-1 | X-1 | X-1 | X-1 | X-1 | X-1 | X-1 | X-2 | X-1 |
| Name of effect pigment dispersion (Y) | | Y-11 | Y-12 | Y-13 | Y-14 | Y-10 | Y-11 | Y-15 | Y-16 | Y-2 | Y-2 |
| Name of clear paint (Z) | | Z-1 | Z-1 | Z-1 | Z-1 | Z-1 | Z-1 | Z-1 | Z-1 | Z-1 | Z-2 |
| Dry film thickness (μm) of effect coating film | | 0.5 | 0.5 | 0.5 | 0.5 | 2 | 0.02 | 0.5 | 0.5 | 0.5 | 0.5 |
| Coating film performance | Graininess (HG value) | 35 | 35 | 35 | 40 | 40 | 38 | 35 | 30 | 33 | 33 |
| | Anti-water adhesion | Pass | Pass | Pass | Pass | Pass | Pass | Pass | Pass | Pass | Pass |
| | 60 degree gloss | 140 | 142 | 143 | 128 | 120 | 140 | 144 | 120 | 145 | 145 |
| | Undercoat hiding power | Pass | Pass | Pass | Pass | Pass | Pass | Pass | Pass | Pass | Pass |

| | | Examples | | Comparative Examples | | |
|---|---|---|---|---|---|---|
| | | 21 | 23 | 1 | 2 | 3 |
| Name of substrate | | 1 | 1 | 1 | 1 | 1 |
| Name of colored paint (W) | | W-1 | W-1 | W-1 | W-1 | W-1 |
| Heating after application of colored paint (W) | | Yes | Yes | Yes | Yes | No |
| Polishing | | No | Yes | No | No | No |
| Name of base paint (X) | | X-1 | X-1 | X-1 | No | X-1 |
| Name of effect pigment dispersion (Y) | | Y-2 | Y-2 | Y-17 | Y-2 | Y-2 |
| Name of clear paint (Z) | | Z-3 | Z-1 | Z-1 | Z-1 | Z-1 |
| Dry film thickness (μm) of effect coating film | | 0.5 | 0.5 | 0.5 | 0.5 | 0.5 |
| Coating film performance | Graininess (HG value) | 33 | 33 | 45 | 30 | 55 |
| | Anti-water adhesion | Pass | Pass | Pass | Pass | Pass |
| | 60 degree gloss | 145 | 145 | 115 | 140 | 113 |
| | Undercoat hiding power | Pass | Pass | Pass | Fail | — |

Evaluation of Coating Films of Examples 24 to 44 and 46 and Comparative Examples 4 to 7

The appearance and performance of the coating film of each test plate obtained in the above manner were evaluated. Table 5 shows the results.

Evaluation of Appearance

The coating film appearance was evaluated based on graininess, anti-water adhesion, specular gloss (60 degree), and undercoat hiding power.

Graininess

The graininess was evaluated as a hi-light graininess value (hereinafter abbreviated as the "HG value"). The HG value is a parameter of microscopic brilliance obtained by the microscopic observation of a coating surface, and indicates the graininess in the highlight. The HG value is calculated as follows. First, the coating surface is photographed with a CCD camera at a light incidence angle of 15° and a receiving angle of 0°, and the obtained digital image data (two-dimensional brilliance distribution data) is subjected to two-dimensional Fourier transformation to obtain a power spectrum image. Subsequently, only the spatial frequency area corresponding to graininess is extracted from the power spectrum image, and the obtained measurement parameter is converted to a numerical value from 0 to 100 that has a linear relation with graininess, thus obtaining an HG value. An HG value of 0 indicates no graininess of the effect pigment at all, and an HG value of 100 indicates the highest possible graininess of the effect pigment.

The graininess HG is preferably 35 to 65, in terms of the denseness of the metallic coating film.

Anti-Water Adhesion

Each test plate was immersed in warm water at 80° C. for 5 hours. Immediately after the test plate was removed from the water, cross-cuts reaching the substrate were made in the multilayer coating film of the test plate using a cutter knife to form a grid of 100 squares (2 mm×2 mm). Subsequently, adhesive cellophane tape was applied to the surface of the grid portion, and the tape was peeled off rapidly at 20° C. Then, the condition of squares remaining was checked, and water resistance was evaluated according to the following criteria.

Pass: 100 squares of the coating film remained, and no small edge peeling of the coating film occurred at the edge of the cut made by the cutter knife.

Fail: The remaining number of squares of the coating film was 99 or less.

Specular Gloss (60 Degree)

The 60 degree gloss value of the test plates obtained above was measured using a gloss meter (micro-TRI-gloss, produced by BYK-Gardner). A numerical value of 105 or more is regarded as acceptance.

Undercoat Hiding Power

In Examples 24 to 44 and Comparative Examples 4 to 7, a colored coating film was formed using the colored paint (W-1) in step (1), and the coating film surface was polished with sandpaper #2000 and wiped off with gasoline, followed by obtaining a multilayer coating film by performing step (2) and the subsequent steps. The obtained multilayer coating film was visually observed to evaluate undercoat hiding power according to the following criteria. The test plate of Example 46 was directly subjected to the test for undercoat hiding power.

Pass: No gouge marks were observed.

Fail: Gouge marks were observed.

The multilayer coating film of the test plate of Comparative Example 6 showed no undercoat hiding power, and was inappropriate as the multilayer coating film of the present invention.

TABLE 5

| | | Example | | | | | | | | | |
|---|---|---|---|---|---|---|---|---|---|---|---|
| | | 24 | 25 | 26 | 27 | 28 | 29 | 30 | 31 | 32 | 33 |
| Name of substrate | | 1 | 1 | 1 | 1 | 1 | 1 | 1 | 1 | 1 | 1 |
| Heating after application of colored paint (W) | | Yes | Yes | Yes | Yes | Yes | Yes | Yes | Yes | Yes | Yes |
| Polishing | | No | No | No | No | No | No | No | No | No | No |
| Name of base paint (X) | | X-1 | X-1 | X-1 | X-1 | X-1 | X-1 | X-1 | X-1 | X-1 | X-1 |
| Name of effect pigment dispersion (Y) | | Y-18 | Y-19 | Y-20 | Y-21 | Y-22 | Y-23 | Y-24 | Y-25 | Y-26 | Y-27 |
| Name of clear paint (Z) | | Z-1 | Z-1 | Z-1 | Z-1 | Z-1 | Z-1 | Z-1 | Z-1 | Z-1 | Z-1 |
| Dry film thickness (μm) of effect coating film | | 0.5 | 0.5 | 0.5 | 0.5 | 0.5 | 0.5 | 0.5 | 0.5 | 0.5 | 0.5 |
| Coating film performance | Graininess (HG value) | 56 | 55 | 55 | 55 | 56 | 60 | 57 | 53 | 58 | 63 |
| | Anti-water adhesion | Pass | Pass | Pass | Pass | Pass | Pass | Pass | Pass | Pass | Pass |
| | 60 degree gloss | 122 | 124 | 125 | 124 | 123 | 118 | 121 | 128 | 120 | 111 |
| | Undercoat hiding power | Pass | Pass | Pass | Pass | Pass | Pass | Pass | Pass | Pass | Pass |

| | | Example | | | | | | | | | |
|---|---|---|---|---|---|---|---|---|---|---|---|
| | | 34 | 35 | 36 | 37 | 38 | 39 | 40 | 41 | 42 | 43 |
| Name of substrate | | 1 | 1 | 1 | 1 | 1 | 1 | 1 | 1 | 1 | 1 |
| Heating after application of colored paint (W) | | Yes | Yes | Yes | Yes | Yes | Yes | Yes | Yes | Yes | Yes |
| Polishing | | No | No | No | No | No | No | No | No | No | No |
| Name of base paint (X) | | X-1 | X-1 | X-1 | X-1 | X-1 | X-1 | X-1 | X-1 | X-2 | X-1 |
| Name of effect pigment dispersion (Y) | | Y-28 | Y-29 | Y-30 | Y-31 | Y-28 | Y-19 | Y-32 | Y-33 | Y-19 | Y-19 |
| Name of clear paint (Z) | | Z-1 | Z-1 | Z-1 | Z-1 | Z-1 | Z-1 | Z-1 | Z-1 | Z-1 | Z-2 |
| Dry film thickness (μm) of effect coating film | | 0.5 | 0.5 | 0.5 | 0.5 | 5 | 0.1 | 0.5 | 0.5 | 0.5 | 0.5 |
| Coating film performance | Graininess (HG value) | 56 | 55 | 57 | 64 | 58 | 64 | 57 | 54 | 56 | 55 |
| | Anti-water adhesion | Pass | Pass | Pass | Pass | Pass | Pass | Pass | Pass | Pass | Pass |
| | 60 degree gloss | 125 | 123 | 124 | 110 | 117 | 107 | 123 | 105 | 124 | 125 |
| | Undercoat hiding power | Pass | Pass | Pass | Pass | Pass | Pass | Pass | Pass | Pass | Pass |

| | Example | | | Comparative Example | | |
|---|---|---|---|---|---|---|
| | 44 | 46 | 4 | 5 | 6 | 7 |
| Name of substrate | 1 | 1 | 1 | 1 | 1 | 1 |
| Heating after application of colored paint (W) | Yes | Yes | Yes | Yes | Yes | No |
| Polishing | No | Yes | No | No | No | No |
| Name of base paint (X) | X-1 | X-1 | X-1 | X-1 | No | X-1 |

TABLE 5-continued

| | | | | | | | |
|---|---|---|---|---|---|---|---|
| Name of effect pigment dispersion (Y) | | Y-19 | Y-19 | Y-34 | Y-35 | Y-19 | Y-19 |
| Name of clear paint (Z) | | Z-3 | Z-1 | Z-1 | Z-1 | Z-1 | Z-1 |
| Dry film thickness (μm) of effect coating film | | 0.5 | 0.5 | 0.5 | 0.5 | 0.5 | 0.5 |
| Coating film performance | Graininess (HG value) | 55 | 55 | 58 | 67 | 57 | 68 |
| | Anti-water adhesion | Pass | Pass | Fail | Pass | Pass | Pass |
| | 60 degree gloss | 125 | 123 | 130 | 103 | 125 | 104 |
| | Undercoat hiding power | Pass | Pass | Pass | Pass | Fail | — |

The embodiments and Examples of the present invention are described in detail above. However, the present invention is not limited to the above-mentioned embodiments, and various modifications can be made based on the technical idea of the present invention.

The invention claimed is:

1. A method for forming a multilayer coating film by sequentially performing the following steps (1) to (5):

(1) applying a colored paint (W) to a substrate having a cationic or an anionic electrodeposition paint (E) applied thereon, followed by heating, to form a colored coating film, (2) applying a base paint (X) to the colored coating film formed in step (1) to form a base coating film, (3) applying an effect pigment dispersion (Y) to the base coating film formed in step (2) to form an effect coating film, (4) applying a clear paint (Z) to the effect coating film formed in step (3) to form a clear coating film, and (5) heating the uncured base coating film, the uncured effect coating film, and the uncured clear coating film formed in steps (2) to (4) to thereby simultaneously cure these three coating films;

wherein the effect pigment dispersion (Y) contains water, a surface adjusting agent (A), a flake-effect pigment (B), and a rheology control agent (C), and has a solids content of 0.5 to 10 mass %;

wherein the surface adjusting agent (A) has a contact angle of 8° to 20° with respect to a previously degreased tin plate, the contact angle being measured in such a manner that a liquid that is a mixture of isopropanol, water, and the surface adjusting agent (A) at a ratio of 4.5/95/1 is adjusted to have a viscosity of 150 mPa·s measured by a Brookfield viscometer at a rotor rotational speed of 60 rpm at a temperature of 20° C., 10 μL of the liquid is added dropwise to the tin plate, and the contact angle with respect to the tin plate is measured 10 seconds after dropping, and wherein the flake-effect pigment (B) is at least one selected from the group consisting of a vapor deposition metal flake pigment and an aluminum flake pigment.

2. The method for forming a multilayer coating film according to claim 1, wherein the effect pigment dispersion (Y) has a viscosity (B60) of 60 to 2000 mPa·s measured using a Brookfield viscometer at a rotor rotational speed of 60 rpm at a temperature of 20° C.

3. The method for forming a multilayer coating film according to claim 1, wherein the surface adjusting agent (A) has a dynamic surface tension of 50 to 70 mN/m.

4. The method for forming a multilayer coating film according to claim 1, wherein the flake-effect pigment (B) is contained in an amount of 0.2 to 5 parts by mass, based on 100 parts by mass of the effect pigment dispersion (Y).

5. The method for forming a multilayer coating film according to claim 1, wherein the rheology control agent (C) is a cellulose nanofiber.

6. The method for forming a multilayer coating film according to claim 1, wherein the effect coating film has a dry film thickness of 0.02 to 5 μm.

7. The method for forming a multilayer coating film according to claim 1, wherein the base coating film is a transparent coating film or a colored coating film.

8. The method for forming a multilayer coating film according to claim 1, wherein the clear paint (Z) is a two-component clear paint containing a hydroxy-containing resin and a polyisocyanate compound.

9. The method for forming a multilayer coating film according to claim 1, wherein the flake-effect pigment (B) is a vapor deposition metal flake pigment, and the multilayer coating film has a 60 degree gloss value of 120 or more and a hi-light graininess value of 10 to 40.

10. The method for forming a multilayer coating film according to claim 1, wherein the flake-effect pigment (B) is an aluminum flake pigment, and the multilayer coating film has a 60 degree gloss value of 105 or more and a hi-light graininess value of 35 to 65.

* * * * *